US010151126B2

(12) United States Patent
Cumbo

(10) Patent No.: US 10,151,126 B2
(45) Date of Patent: Dec. 11, 2018

(54) LATCH FOR A DOOR OF A MOTOR VEHICLE

(71) Applicant: Magna Closures Inc., Newmarket (CA)

(72) Inventor: Francesco Cumbo, Pisa (IT)

(73) Assignee: Magna Closures Inc., Newmarket (CA)

( * ) Notice: Subject to any disclaimer, the term of this patent is extended or adjusted under 35 U.S.C. 154(b) by 879 days.

(21) Appl. No.: 14/627,466

(22) Filed: Feb. 20, 2015

(65) Prior Publication Data

US 2015/0240537 A1 Aug. 27, 2015

(30) Foreign Application Priority Data

Feb. 24, 2014 (IT) ..... TO2014A0153

(51) Int. Cl.
*E05B 85/00* (2014.01)
*E05B 85/20* (2014.01)
*E05B 77/06* (2014.01)

(52) U.S. Cl.
CPC ..... *E05B 85/20* (2013.01); *E05B 77/06* (2013.01); *Y10T 292/108* (2015.04)

(58) Field of Classification Search
CPC ..... E05B 77/06; E05B 77/42; Y10S 292/22; Y10S 292/23
USPC ..... 292/200
See application file for complete search history.

(56) References Cited

U.S. PATENT DOCUMENTS 3,799,596 A * 3/1974 Nozomu ..... E05B 77/06 180/286
6,042,159 A * 3/2000 Spitzley ..... E05B 77/06 16/111.1
6,554,331 B2 * 4/2003 Ciborowski ..... E05B 85/16 292/336.3
8,029,032 B1 * 10/2011 Yang ..... E05B 77/06 292/336.3
8,727,402 B2 * 5/2014 Bejune ..... E05B 77/04 292/336.3
2007/0024068 A1 * 2/2007 Wood ..... E05B 77/06 292/336.3

(Continued)

FOREIGN PATENT DOCUMENTS

DE 202009017667 U1 6/2011
DE 202010010577 U1 12/2011

(Continued)

OTHER PUBLICATIONS

International Search Report dated Nov. 18, 2014.
Written Opinion dated Nov. 18, 2014.

*Primary Examiner* — Mark A Williams
(74) *Attorney, Agent, or Firm* — Dickinson Wright PLLC

(57) ABSTRACT

A latch for a door of a motor vehicle includes a supporting body, a closing assembly adapted to cooperate with a latch striker, and an opening mechanism which can move between a latched configuration and an unlatched configuration. An inertia lever is fitted to the supporting body and is free to oscillate from a first position to a second position. The latch includes a blocking lever movable between a release position and a stable blocking position. The inertia lever and the blocking lever are coupled in such a way that movement of inertia lever from the first position and the second position causes the movement of blocking lever from the release position to the stable blocking position.

25 Claims, 14 Drawing Sheets

(56) References Cited

U.S. PATENT DOCUMENTS

| | | | | |
|---|---|---|---|---|
| 2007/0080547 | A1* | 4/2007 | Lee | E05B 77/06 292/336.3 |
| 2009/0223263 | A1* | 9/2009 | Puscas | E05B 77/06 70/237 |
| 2013/0328325 | A1 | 12/2013 | Uehara et al. | |

FOREIGN PATENT DOCUMENTS

| | | | |
|---|---|---|---|
| DE | 102011010816 | A1 | 8/2012 |
| EP | 2636827 | A2 | 9/2013 |
| GB | 2275727 | A | 9/1994 |

* cited by examiner

LATCH FOR A DOOR OF A MOTOR VEHICLE

CROSS-REFERENCE TO RELATED APPLICATIONS

This application claims the benefit and priority of Italian Patent Application No. TO2014A000153 filed Feb. 24, 2014. The entire disclosure of the above application is incorporated herein by reference.

FIELD

The present invention relates a latch for a door of a motor vehicle.

BACKGROUND

This section provides background information related to the present disclosure which is not necessarily prior art.

In the following description and accompanying Claims, the term "door" is used broadly speaking to indicate any member movable between an open position and a closed position respectively opening and closing an access opening to an inner compartment of a vehicle, and therefore also includes boot and bonnet lids and rear hatches, in addition to the side doors of vehicles referred to in the description purely by way of example.

As is known, the vehicle doors normally comprise a frame-like top portion defining a window frame closed by a movable window when this is raised, and a box-like bottom portion comprising an outer panel and an inner panel joined at one end by an end edge and defining in between a cavity normally housing the window, when this is lowered, and various component parts fixed to the panels, such as a latch and a window regulating device.

A conventional latch typically includes a supporting body fixed to the vehicle door, a striker fixed to a frame of the vehicle door, a closure assembly carried by the supporting body and adapted to releasably engage the striker, and a release mechanism which is operatively connected to an outer handle of the door and can be selectively activated to release the closure assembly from the striker. More in detail, the closure assembly includes a ratchet which defines an open cylindrical seat, and a pawl. The ratchet is elastically loaded toward an opening position in which the ratchet enables engagement and disengagement between the striker and the seat of the ratchet. Furthermore, the ratchet is rotatably movable between the opening position and a closing position in which the ratchet holds the striker and prevents the disengagement of the striker from the closure assembly. The pawl is elastically loaded toward the ratchet for keeping the ratchet in the closing position. However, the pawl may be moved away from the ratchet by the release mechanism so as to allow the ratchet to elastically return to the opening position.

One conventional latch is known from EP-A-1371799, in which the release mechanism includes an extension lever which is operatively connected to the outer handle of the door, and a release lever which is hinged to the extension lever and can move from a latched position into an unlatched position when the outer handle of the door is flexed. When the ratchet is in the closing position, the release lever is in the latched position and is disengaged from the pawl. When the outer handle is flexed and the release lever moves from the latched position to the unlatched position, an end portion of the release lever moves the pawl away from the ratchet so as to allow the ratchet to return in the opening position. The release mechanism also includes an inertia actuated lever which is operatively coupled to the release lever for securing the release lever in the latched position. In greater detail, the inertia lever is hinged to a frame of the latch and comprises a detent tab for selectively engaging the release lever in the latched position. In a normal situation, the inertia lever is arranged in a release position, in which the detent tab is offset from the release lever in order to allow the release lever to move from the latched position to the unlatched position in response to activation of the outside handle. However, in case of collision, the inertia lever moves from the release position to a blocking position in which the detent tab blocks the release lever and prevents it from moving from the latched position into the unlatched position.

Improvements and alternatives to such inertia type latches are desirable.

SUMMARY

This section provides a general summary of the disclosure and is not intended to be considered as a comprehensive disclosure of its full scope or all of its objects and features.

It is therefore an object of the present invention to provide an inertia latch for a motor vehicle including such improvements or alternatives.

This object is achieved by a latch for a door of a motor vehicle as claimed in claim 1. In particular, a latch for a door of motor vehicle constructed according to the present invention comprises: a supporting body; a closing assembly adapted to cooperate with a latch striker and which can assume a closing configuration in which it engages said latch striker and keeps it in a fixed position and an open configuration in which it is disengaged from said latch striker, an opening mechanism which can selectively move between a latched configuration in which it leaves the closing assembly in the closing configuration and an unlatched configuration in which it causes the closing assembly to move from the closing configuration to the opening configuration; and an inertia lever which is fitted to the supporting body and can move with respect to the supporting body from a first position to a second position.

A blocking lever is movable between a release position in which it allows the opening mechanism to move from the latched configuration to the unlatched configuration and a stable blocking position in which the blocking lever prevents, either directly or indirectly, the opening mechanism from moving from the latched configuration to the unlatched configuration. The inertia lever and the blocking lever are coupled in such a way that the movement of the inertia lever from the first position to the second position causes the movement of the blocking lever from the release position to the stable blocking position.

This object is also achieved by a latch for a door of a motor vehicle as claimed in claim 22. In particular, a latch for a door of motor vehicle constructed according to the present invention comprises: a supporting body; a closing assembly adapted to cooperate with a latch striker and which can assume a closing configuration in which it engages the latch striker and keeps it in a fixed position, and an open configuration in which it is disengaged from said latch striker; an opening mechanism which can selectively move between a latched configuration in which it leaves the closing assembly in the closing configuration and an unlatched configuration in which it causes the closing assembly to move from the closing configuration to the opening configuration; and an inertia activated blocking mechanism which can be move under inertia action from a release configuration in which it allows the opening mechanism to move from the latched configuration to the unlatched configuration to a stable blocking configuration in which it prevents said opening mechanism from moving from the latched configuration to unlatched configuration.

In accordance to the latch constructed as above, the opening mechanism comprises: a first lever operatively connected to an outer handle of said door and which moves between a first latched position in which it is leaves the closing mechanism in the dosed configuration and a first unlatched position in which it causes the closing mechanism to move in the open configuration; and a second lever operatively connected to an inner handle of the door and which moves between a second latched position in which it is leaves the closing mechanism in the dosed configuration, and a second unlatched position in which it causes the closing mechanism to move in the open configuration. The displacement of the second lever from the second latched position to the second unlatched position causes the movement of the inertia activated blocking mechanism back from the stable blocking configuration to the release configuration.

This object is also achieved by a latch for a door of a motor vehicle as claimed in claim 23. In particular, a latch for a door of motor vehicle constructed according to the present invention comprises: a supporting body; a closing assembly adapted to cooperate with a latch striker and which can assume a closing configuration in which it engages the latch striker and keeps it in a fixed position and an open configuration in which it is disengaged from the latch striker; an opening mechanism, which can selectively move between a latched configuration in which it leaves the closing assembly in the closing configuration and an unlatched configuration in which it causes closing assembly to move from the closing configuration to the opening configuration; and an inertia activated blocking mechanism which can be move under the inertia action from a release configuration in which it allows the opening mechanism to move from the latched configuration to the unlatched configuration to a stable blocking configuration in which it prevents the opening mechanism from moving from the latched configuration to unlatched configuration.

In accordance with the latch constructed as above, the opening mechanism comprises: a first lever operatively connected to an outer handle of the door and which moves between a first latched position in which it is leaves the closing mechanism in the dosed configuration and a first unlatched position in which it causes the closing mechanism to move in the open configuration; and a second lever operatively connected to an inner handle of the door and which moves between a second latched position in which it is leaves the closing mechanism in the closed configuration and a second unlatched position in which it causes the closing mechanism to move in the open configuration. The blocking lever when set in the stable blocking position prevents the first lever from moving from the first latched position to the first unlatched position.

This object is also achieved by a latch for a door of a motor vehicle as claimed in claim 24. In particular, a latch for a door of motor vehicle constructed according to the present invention comprises: a supporting body; a closing assembly adapted to cooperate with a latch striker and which can assume a closing configuration in which it engages the latch striker and keeps it in a fixed position, and an open configuration in which it is disengaged from the latch striker; an opening mechanism which can selectively move between a latched configuration in which it leaves the closing assembly in the closing configuration, and an unlatched configuration in which it causes closing assembly to move from the closing configuration to the opening configuration; and an inertia lever is fitted to the supporting body and can move with respect to the supporting body from a first position to a second position.

A blocking lever is movable between a release position in which it allows the opening mechanism to move from the latched configuration to the unlatched configuration and a stable blocking position in which it prevents, either directly or indirectly, the opening mechanism from moving from the latched configuration to the unlatched configuration. The inertia lever and the blocking lever are coupled in such a way that the movement of the inertia lever from the first position to the second position causes the movement of the blocking lever from the release position to the stable blocking position. The blocking lever is hinged about an axis and movable in a plane transversal to the axis between the release position and the stable blocking position.

Further areas of applicability will become apparent from the description provided herein. The description and specific examples in this summary are intended for purposes of illustration only and are not intended to limit the scope of the present disclosure.

DRAWINGS

A preferred, non-limiting embodiment of the present invention will be described by way of example with reference to the accompanying drawings, in which.

DETAILED DESCRIPTION

Figures 1, 16:
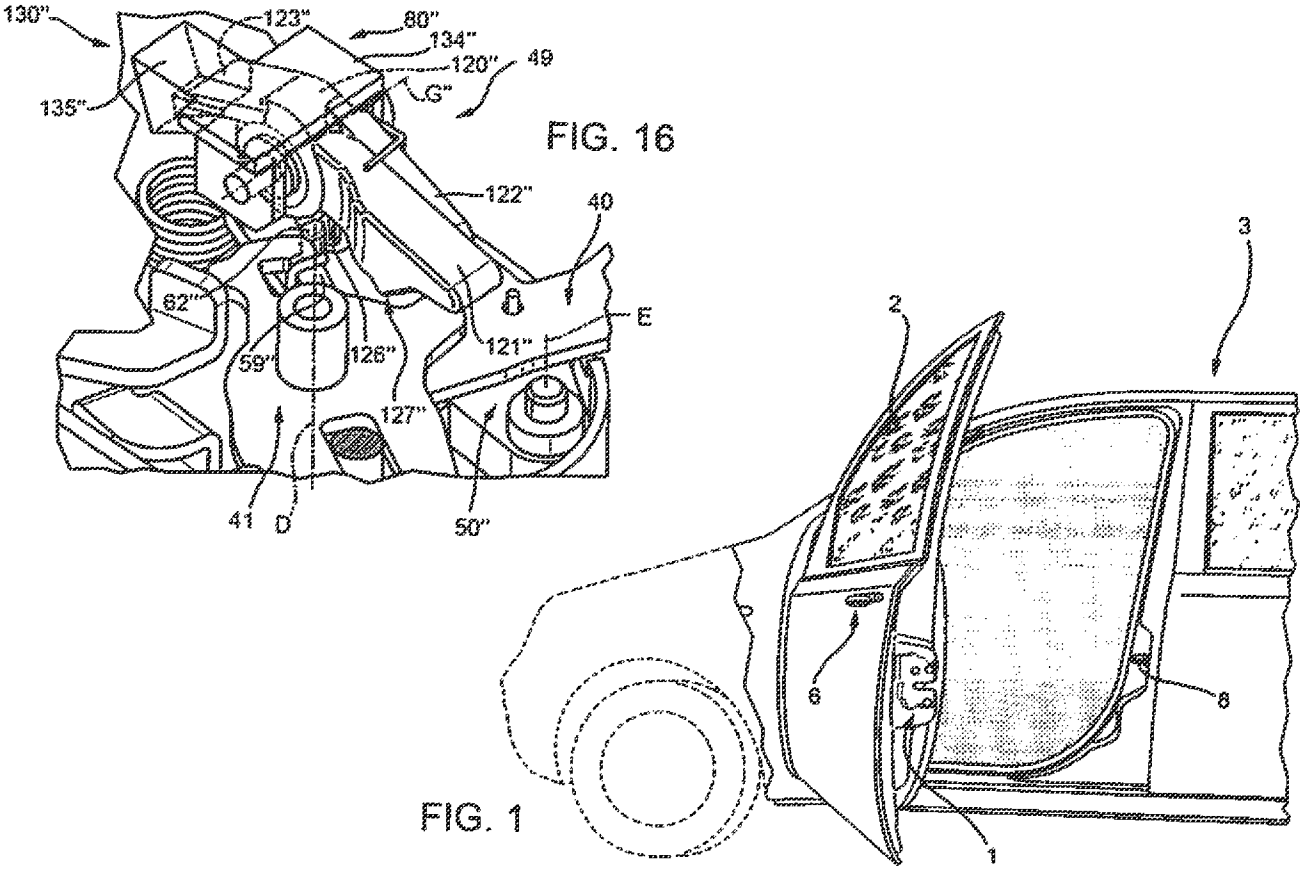
FIG. 1 is a schematic view of a door of a motor-vehicle with a latch constructed in accordance with the present disclosure.
FIG. 16 is a larger scale perspective view of the latch of FIGS. 10 to 13 taken from a second perspective angle, with parts removed for clarity.

One or more example embodiments will now be described more fully with reference to the accompany drawings. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to FIGS. 1 to 6, a latch 1 for a door 2 of a motor vehicle 3 is generally shown. The door 2 is movable between an open position and a dosed position to open and close an access opening to an inner compartment of the motor vehicle 3. The door 2 includes a frame-like top portion that defines a window frame closed by a movable window when the window is raised and a box-like bottom portion 4 having an outer panel and an inner panel joined at one end by an end edge and defining in between a cavity normally housing the window, when this is lowered, and various component parts fixed to the panels, such as a latch 1 and a window regulating device.

In greater detail, latch 1 comprises: a supporting body 11 fixed in known manner to door 2; a closure assembly 12 carried by supporting body 11 and engaging a striker 8 integrally carried to a fixed part of motor vehicle 1; and an opening mechanism 13 which may operated by a user to disengage striker 8 from closure assembly 12. Furthermore, supporting body 11 comprises a hollow shell 14 (only partially shown in FIGS. 2 to 6), which houses the closure assembly 12.

Shell 14 is shown only with reference to a plate 15 and a wall 16 projecting from plate 15 and substantially orthogonal to wall 16. The closure assembly 12 comprises: a ratchet 20 hinged to plate 15 about an axis A extending orthogonal to the plane on which plate 15 lies; a pawl 21 hinged to plate 15 about an axis B extending orthogonal to the plane on which plate 15 lies and parallel to and staggered from axis B; and a pawl lever 26, which is coaxial with pawl 21 and angularly movable with pawl 21 about axis B. More precisely, ratchet 20 comprises a seat 17 bounded by a pair of teeth 22, 23 and configured for receiving striker 8. Accordingly to an aspect, the seat can be u-shaped.

Ratchet 20 is loaded by a spring 19 toward an opening position (not shown) in which seat 17 faces a direction C which is orthogonal to axes A, B along which striker 8 may enter or exit that seat 17. Spring 19 is interposed between plate 15 and ratchet 20 and, according to an aspect, is a spiral wound about axis A. In particular, spring 19 is wound about a pin 18 which extends about axis A. As best shown in FIG. 2-6, under the action of striker 8 and as a result of the closing of door 2, ratchet 20 rotates, when moving from the opening position to a closing position in a first rotation direction (anti-clockwise) about axis A.

Figure 2:
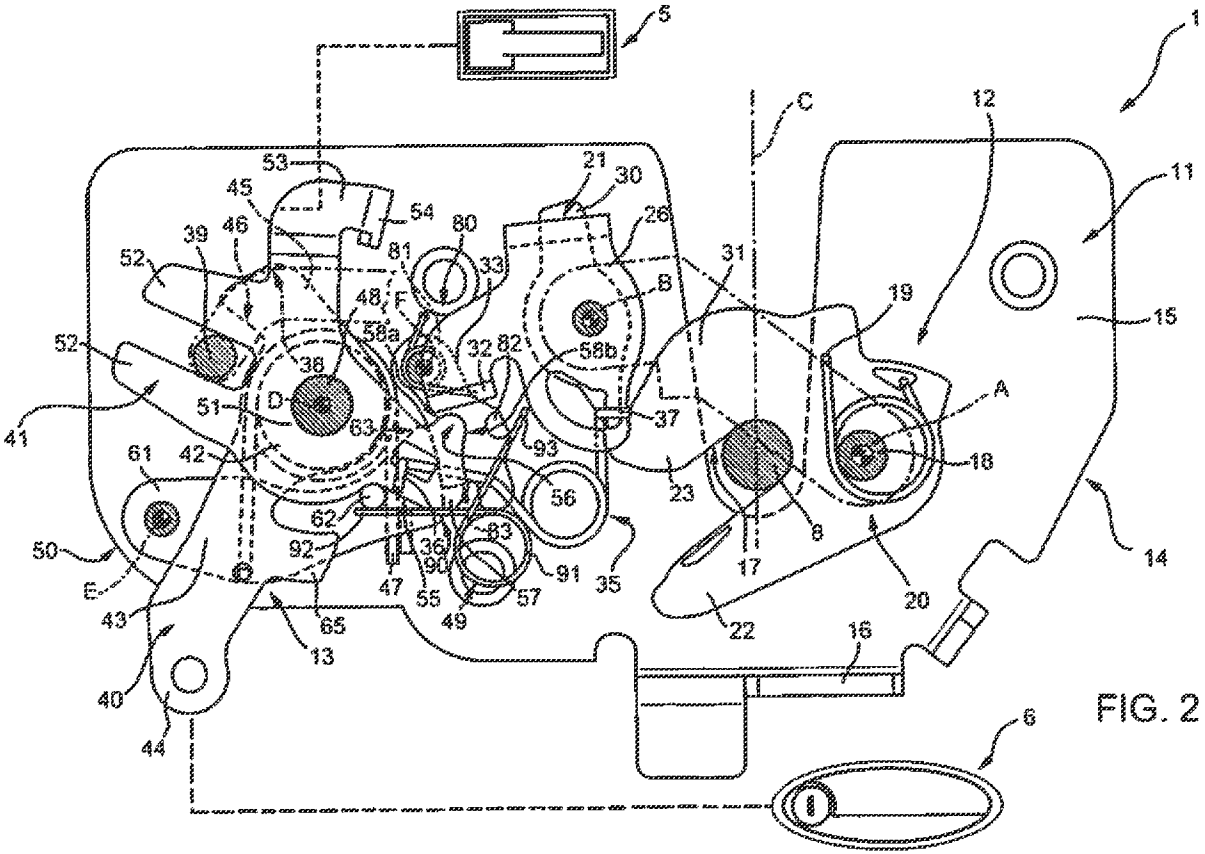
FIG. 2 is a top view of the latch of FIG. 1 during a normal operation of the motor vehicle and illustrating an opening mechanism of the latch in an latched position, an inertia lever in a first position, and a blocking lever in a release position, with parts removed for clarity.

According to an aspect, pawl 21 comprises: a plate 30 hinged about axis B to plate 15 and lying on a plane orthogonal to axis B, and a tooth 31 defined by plate 30. As best shown in FIG. 2, pawl 21 is elastically loaded by a spring (not expressly shown) towards a position, in which tooth 31 contacts tooth 23 of ratchet 20 and blocks the latter in the closing position. Pawl lever 26 comprises an arm 33 from which an appendix 32 orthogonally protrudes on the opposite side of tooth 31. Appendix 32 is adapted to receive an action by opening mechanism 13, so as to move pawl 21 in a second direction—clockwise in FIGS. 2 to 6—about axis B and to render ratchet 20 free to rotate about axis A in the first direction—anticlockwise in FIGS. 2 to 6—towards the opening position.

Figure 3:
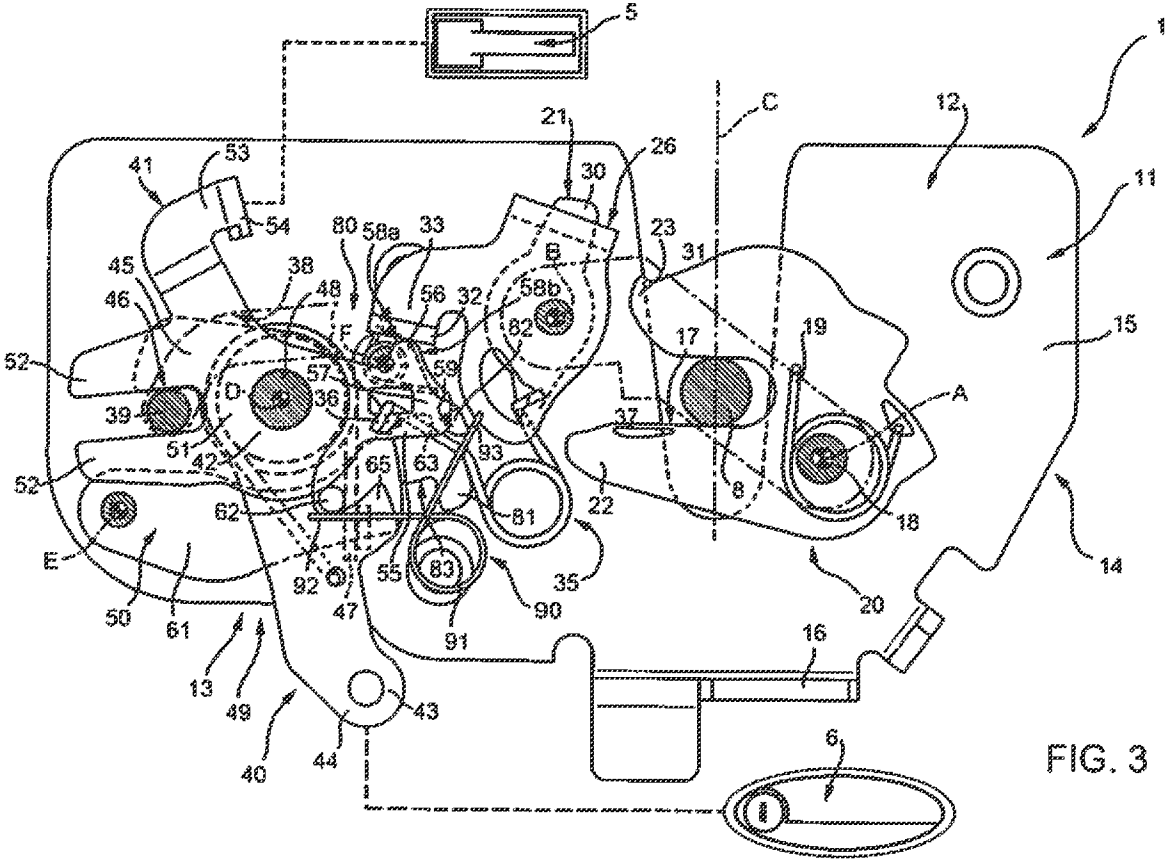
FIG. 3 is a top view of the latch of FIGS. 1 and 2, illustrating the opening mechanism in an unlatched position, the inertia lever in the first position, and the blocking lever in the release position.
Figure 4:
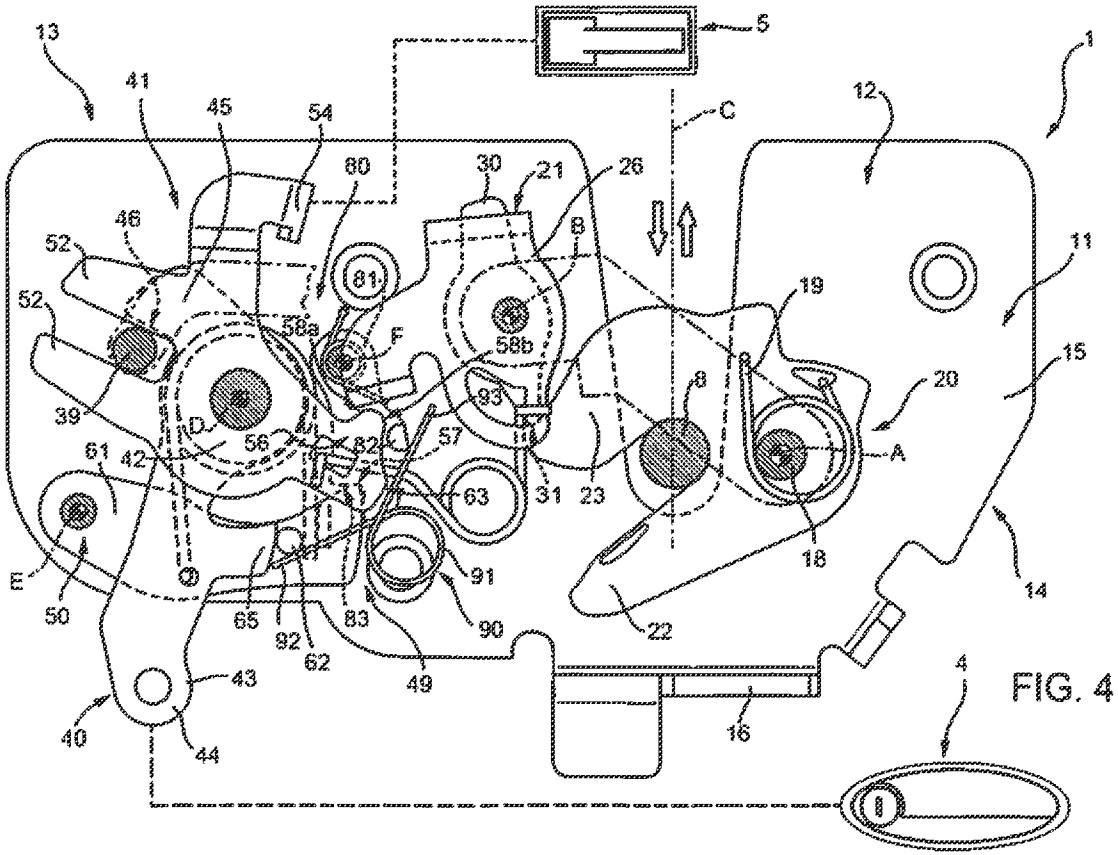
FIG. 4 is a top view of the latch of FIGS. 2 to 3, illustrating the opening mechanism in the unlatched position, the inertia lever in the second position, and the blocking lever in a stable blocking position.
Figure 5:
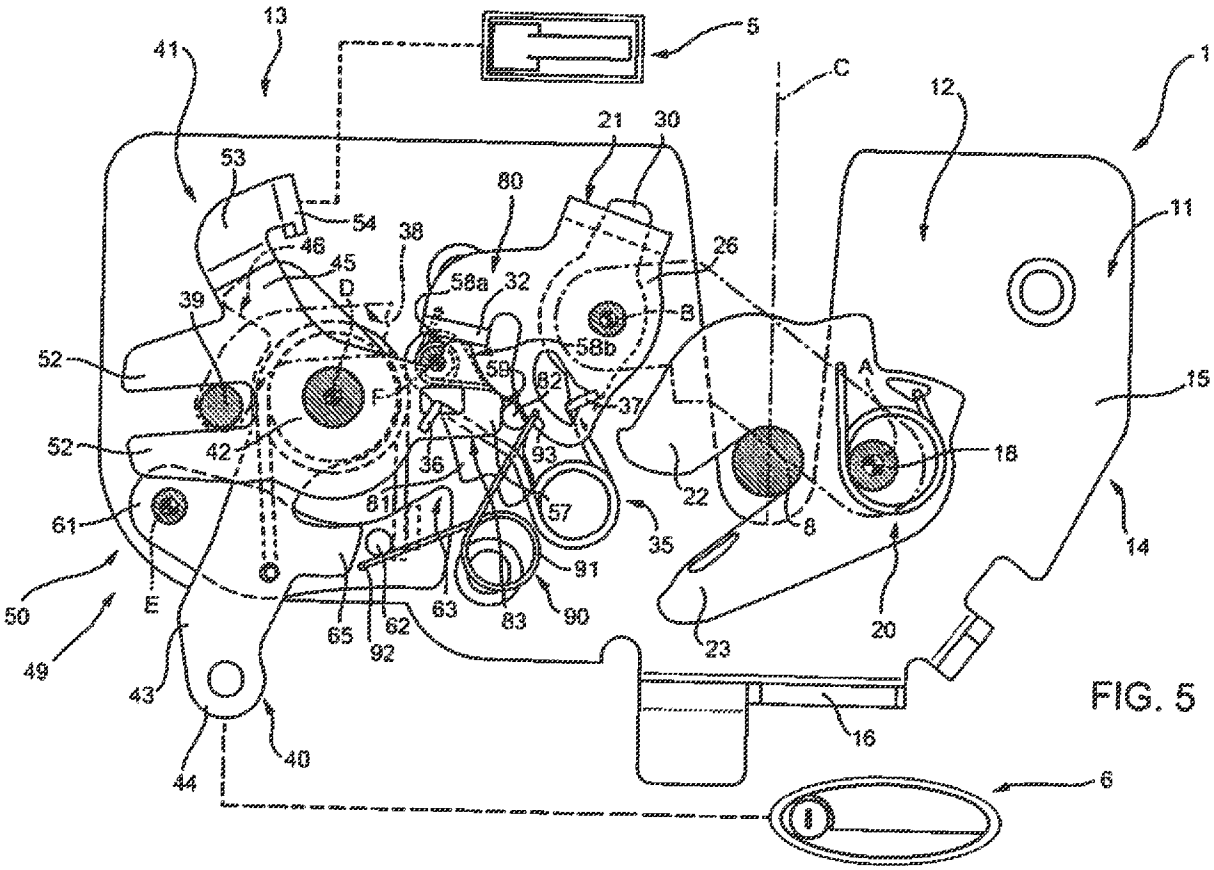
FIG. 5 is a top view of the latch of FIGS. 1 to 4, showing a reset operation during which the blocking lever returns back in the release position.
Figure 6:
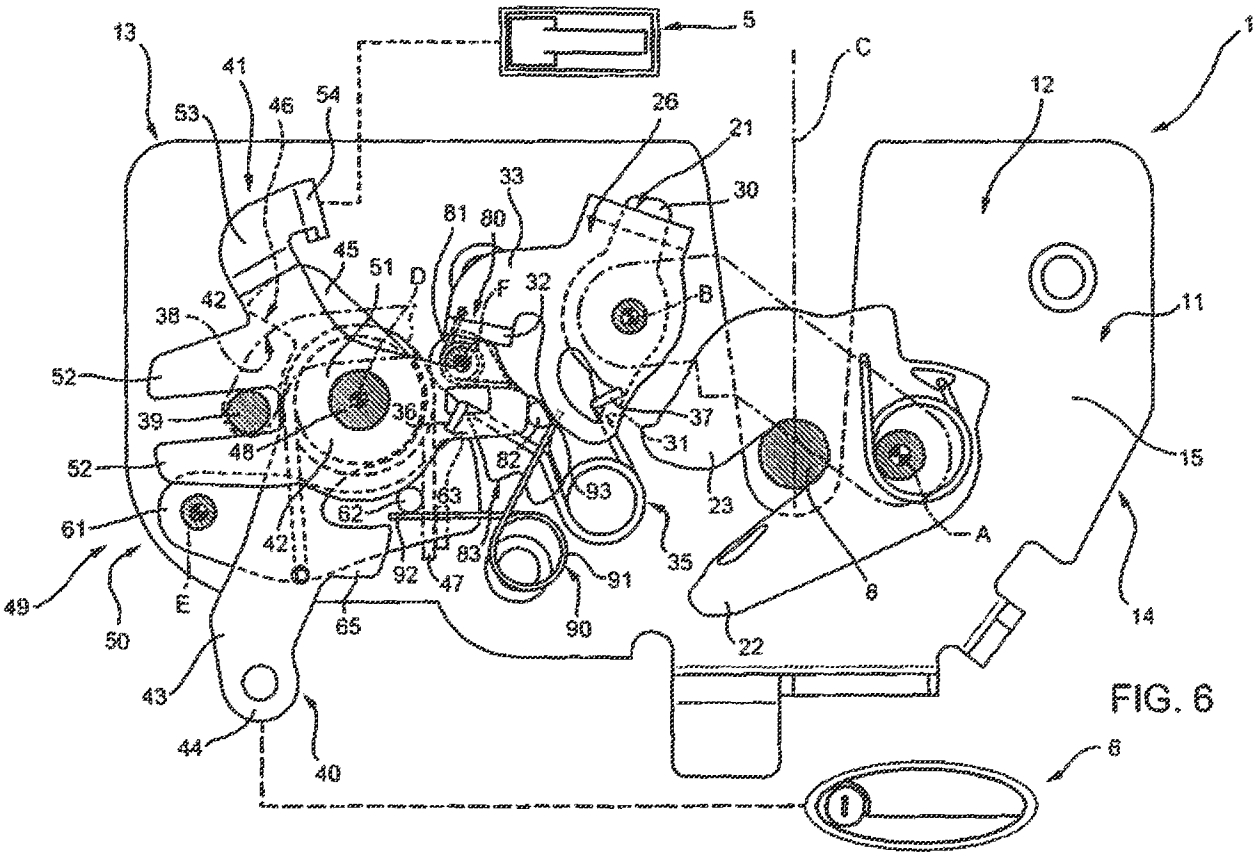
FIG. 6 is a top view of the latch of FIGS. 1 to 4, showing a reset operation during which the blocking lever returns back in the release position.

According to an aspect, and as best shown in FIG. 1-6, opening mechanism 13 comprises: an outer lever 40 hinged about an axis D and operatively connected to an outer handle of door 2 and an inner lever 41 hinged about axis D and operatively connected to an inner handle 5 of door 2. Opening mechanism 13 is movable between a latched configuration, in which it is disengaged from pawl lever 26 and pawl 21, and leaves pawl 21 and ratchet 20 engaged therebetween (FIGS. 2 and 4 to 6); and an unlatched configuration, in which it is engaged with pawl lever 26 and pawl 21 and causes the disengagement of pawl 21 from ratchet 20 and the return of ratchet 20 in the opening position (FIG. 3). In greater detail, lever 41 is movable between a latched position, as best shown in FIGS. 2, 4 and 6, in which it is disengaged from pawl lever 26, so that pawl lever 26 and pawl 21 can elastically keep pawl 21 and ratchet 20 in the closing position and an unlatched position, as best shown in FIG. 3, in which it interacts with pawl lever 26, so as to rotate it about axis B in the second direction—clockwise—thus disengaging pawl 21 and ratchet 20 from one another and causing ratchet 20 to return in the opening position.

When lever 41 is in the unlatched position, opening mechanism 13 is in the unlatched configuration. When lever 41 is in the latched position, opening mechanism 13 is in the latched configuration. In particular, when inner handle 5 is flexed, lever 41 is displaced from the latched position to the unlatched position. Inner handle 5 is elastically loaded towards a not-flexed position and remains in the not flexed position during a collision and under an acceleration directed parallel to direction C. Furthermore, lever 41 is elastically loaded towards the respective latched position.

According to an aspect, lever 40 is movable between a latched position, as best shown in FIGS. 2, 4, and 6, in which lever 40 is disengaged from pawl lever 26 so as to keep pawl 21 and ratchet 20 in the closing position and an unlatched position, as best shown in FIG. 3, in which it interacts, directly or indirectly, with pawl 21 so as to rotate pawl 21 about axis B in the second direction (clockwise in FIGS. 2 to 6), thus disengaging pawl 21 and ratchet 20 from one another and causing ratchet 20 to return in the opening position. In particular, when outer handle 6 is flexed, lever 40 moves from the latched position to the unlatched position. Furthermore, lever 40 is elastically loaded towards the respective latched position, and in an aspect, levers 40, 41 are coupled to one another. The movement of lever 40 from the respective latched position to the respective unlatched position, upon the action of outer handle 6 causes the movement of lever 41 from the respective latched position and the respective unlatched position. As a result, pawl 21 disengages from ratchet 20, which can therefore moves towards the opening position.

In more detail, lever 40 lies on a plane orthogonal to axis D and comprises: a main portion 42 hinged to supporting body 11 about axis D; an arm 43 which protrudes from portion 42 and has an end 44 operatively connected to handle 6; and an arm 45, which protrudes from portion 42 in a sloped way with respect to arm 43 and defines a tooth 46. Lever 40 further comprises a tooth 65 protruding from main portion 42.

Latch 1 also comprises a spring 47, which is interposed between supporting body 11 and lever 40 and is adapted to elastically load lever 40 towards the latched position. In detail, spring 47 is wound about axis D about a pin 48 protruding from main portion 42 and has opposite ends connected to arm 43 of lever 40 and supporting body 11. According to an aspect, portion 42 is cylindrical, however other shaped of the portion can be used without departing from the scope of the subject disclosure.

Upon action of outer handle 6 on end 43, lever 40 rotates in the first direction—anticlockwise in FIGS. 2 to 6—from the latched position to the unlatched position. Lever 41 lies on a plane orthogonal to axis D and is superimposed to lever 40. According to an aspect, lever 41 comprises: a main portion 51 hinged to supporting body 11 about axis D and lying orthogonally to axis D; a pair of teeth 52 defined by portion 51 and defining therebetween an open slot; an arm 53 defining an end appendix 54 operatively connected to inner handle 5; and an arm 55 which defines a tooth 56 and a tooth 57 angularly spaced from one another.

As best shown in FIGS. 2, 4, and 6, tooth 56 is spaced from appendix 32 of pawl lever 26, when levers 40, 41 are in respective latched positions and pawl 21 is engaged with ratchet 20 in the closing position. As best shown in FIG. 3, tooth 56 contacts and thrusts appendix 32 of pawl lever 26 on the opposite side of ratchet 20, when levers 40, 41 are in respective latched position, thus causing the rotation of ratchet 20 in the opening position. Tooth 56 is bounded by a pair of curved surfaces 58*a*, 58*b*, and tooth 57 is bounded by a flat surface 59.

Latch 1 also comprises a spring 35 interposed between pawl lever 26 and lever 41. Still more precisely, spring 35 is wound about an axis parallel to axes A. B and D, and comprises opposite ends 36, 37. End 36 is fitted to arm 55 of lever 41 while end 37 is fitted to tooth 31 of pawl lever 26.

Latch 1 also comprises a groove 38 and a pin 39, which slides inside groove 38 and extends parallel to axes A, B, D. Pin 39 engages groove 38 and can be contacted by arm 45 of lever 40, when lever 40 rotates in the first direction—anticlockwise with reference to FIGS. 2 and 6—upon the activation of handle 6 (see FIG. 2). Furthermore, pin 39 is interposed between teeth 52 of lever 41. As a result, the movement of pin 39 inside groove 38 causes the rotation of lever 41 in the first direction—anticlockwise with reference to FIGS. 1 and 4.

Latch 1 further comprises an inertia-activated blocking mechanism 49, which is structured to prevent opening mechanism 13 from accidentally moving from the latched configuration to the unlatched configuration, under the acceleration resulting from a collision of motor vehicle 3, especially a side collision. The acceleration has generally a main component along direction C.

In greater detail, blocking mechanism 49 comprises an inertia lever 50 which is fixed to supporting body 11. Inertia lever 50 is hinged to supporting body 11 about an axis E and can rotate about axis E. Inertia lever 50 rotates, due to its mass, about axis E from a first position (FIGS. 2, 3 and 6) to a second position (shown in FIGS. 4 and 5) in the second direction—clockwise with reference to FIGS. 2 to 6—as a result of a collision of motor vehicle 3, in particular under an acceleration directed parallel to direction C and downwards with reference to FIGS. 2 to 6. In particular, lever 50 rotates in a plane orthogonal to axis E between the first position and the second position. In the embodiment shown, axis E is arranged on the opposite side of axes A, B with respect to axis D. In particular, axis E is parallel to axes A, B and D.

Inertia lever 50 comprises, in turn, an arm 61 hinged about axis E to supporting body 11 and a pin 62 protruding from arm 61 and arranged on the opposite side of arm 61 with respect to axis E. With reference to FIGS. 2 to 6, arm 61 is arranged below levers 41, 40 proceeding parallel to axes A, B. D, and pin 62 upwardly protrudes from arm 61 parallel to axes A, B, D, E and up to the level of lever 40. As best shown in FIG. 1-4, lever 40 is arranged above inertia lever 50. Pin 62 is detached from the trajectory of lever 40 from the latched position to the unlatched position, when inertia lever 50 is in the first position. In this way, and as best shown in FIGS. 2 and 3, lever 40 can rotate from the latched position to the unlatched position.

As best shown in FIG. 4, pin 62 abuts against tooth 65 of lever 40, when inertia lever 50 is in the second position, thus preventing lever 40 from moving from the latched position to the unlatched position. Arm 61 of inertia lever 50 defines, on the opposite side of axis E and on the side of lever 41, an apex 63, the function of which will be clear in the foregoing of the present description. In the embodiment shown, inertia lever 50 is preferably made of a material commercial known as ZAMAK, i.e. a family of alloys with a base metal of zinc and alloying elements of aluminum, magnesium and copper.

Inertia activated blocking mechanism 49 further comprises a blocking lever 80 which is movable between a release position (FIGS. 2, 3, 5 and 6) in which it allows opening mechanism 13 to move from the latched configuration to the unlatched configuration and a stable blocking position (FIG. 4) in which it indirectly prevents opening mechanism 13 from moving from the latched configuration to the unlatched configuration. The inertia lever 50 and blocking lever 80 are coupled in such a way that the movement of inertia lever 50 from the first position to the second position causes the movement of blocking lever from release position to stable blocking position. In greater detail, blocking lever 80, when set in the stable blocking position, blocks inertia lever 50 in the second position and inertia lever 50, when set in the second position, and prevents opening mechanism 13 from moving from the latched configuration to the unlatched configuration.

Blocking lever 80 is hinged to supporting body 11 about an axis F and rotates in the second direction—clockwise in FIGS. 2 to 6—from the release position to the stable blocking position, when inertia lever 50 rotates from the first position to the second position. Blocking lever 80 rotates in a plane orthogonal to axis F between the release position and the stable blocking position. It also important to point out that blocking lever 80 is a solid lever, which is made of rigid material. In other words, blocking lever 80 is different from a spring.

Blocking lever 80 comprises: a main plate 81, which lies on a plane orthogonal to axis F; and a pin 82 protruding from plate 81 parallel to axis F. Plate 81 also comprises a pair of walls inclined and incident with one another and defining a hollow vane 83. Vane 83 is arranged on the side of inertia lever 50 and on the opposite side of pin 82. In the embodiment shown, blocking lever 80 further comprises: a first end hinged to supporting body 11 about axis F; and a second end, opposite to the first end, and defining vane 83. Axis F is, in the embodiment shown, parallel to axis A, B, D and E. Axis F is, in the embodiment shown, in also interposed between axis D and axes A, B.

Latch 1 comprises a spring 90 interposed between blocking lever 80 and inertia lever 50. Blocking lever 80 has a neglectable mass, so that its position is not affected by the acceleration along direction C during the collision. As best shown in FIG. 2, spring 90 pre-loads inertia lever 50 towards the first position and blocking lever 80 towards the release position (FIG. 2). In more detail, spring 90 comprises: a main portion 91, preferably cylindrical, fixed to supporting body 11 and wound about an axis parallel to axes A, B, D, E, F; an arm 92 fixed to arm 43 of lever 50, to pin 62 in the embodiment shown; and an arm 93, disposed opposite to arm 92 and fixed to plate 81 of lever 80.

When inertia lever 50 moves in the second position, as a result of the acceleration acting parallel to direction C, the elastic action of spring 90 displaces blocking lever 80 in the stable blocking position. Sa best shown in FIG. 4, when blocking lever 80 is in the stable blocking position, pin 82 is slightly detached from tooth 57 of lever 41. Furthermore, blocking lever 80, when set in the stable blocking position, keeps inertia lever 50 in the second position, in which pin 62 is interposed along the trajectory of lever 40 from the latched position to the unlatched position. In other words, blocking lever 80, when set in the stable blocking position, indirectly prevents, through the interposition of inertia lever 50, lever 40 from moving from the latched position to the unlatched position. Furthermore, when blocking lever 80 is in the stable blocking position and inertia lever 50 in the second position, apex 63 of inertia lever 50 engages vane 83 of blocking lever 80. In this way, inertia lever 50 is prevented from rebounding between the first position and the second position (FIG. 4).

With reference to FIGS. 5 and 6, the activation of inner handle 5 moves back blocking lever 80 from the stable blocking position to the release position. In particular, when inner handle 5 is actuated, lever 41 rotates in the first direction—anticlockwise in FIG. 6. As a result, surface 59 tooth 57 of lever 41 thrusts pin 82 and blocking lever 80 in the first direction—anticlockwise in FIG. 6, and then surface **58*b* of tooth 56 contacts appendix 32 of pawl lever 26**.

Blocking lever 80, under the action of spring 90, comes back in the release position and disengages inertia lever 50. Inertia lever 50 rotates, under the action of spring 90, about axis E in the first direction—anticlockwise in FIG. 6—up to reach, under the action of spring 90—the first position.

The operation of latch 1 is more fully described in the following, starting from a configuration, as best shown in FIG. 2, in which latch 1 locks door 2 to frame 4. In this configuration, ratchet 20 is in the closing position and pawl 21 is elastically loaded into the closing position of ratchet 20, in which tooth 31 of pawl 21 contacts tooth 23 of ratchet 20. Furthermore, levers 40, 41 of the opening mechanism 13 are loaded by spring 47 in respective latched positions, in which they do not engage pawl lever 26.

Still more precisely, surface **58*a* tooth 56 is angularly spaced from appendix 32 of pawl 21, when levers 40, 41 are in the respective latched positions. Additionally, inertia lever 50 and blocking lever 80 are kept in a stable way by spring 90 in the first position and in the release position respectively. Accordingly, pin 62 of inertia lever 50 is disengaged from tooth 65 of lever 40. Pin 82 of blocking lever 80 is detached from tooth 57 of lever 41**.

When handle 6 is flexed, lever 40 rotates in the first direction—anticlockwise in FIGS. 2 to 6—about axis D—with no interference with pin 62, as shown in FIG. 3. As a result, tooth 56 contacts pin 39, which, in turn, causes the rotation of lever 41 in the first direction—anticlockwise in FIGS. 2 to 6—about axis D. As a result of the rotation of lever 41 in the first direction, tooth 56 contacts appendix 32 of pawl lever 26. Accordingly, pawl lever 26 and pawl 21 rotate, against the action of the spring, about axis B in the second direction—clockwise in FIGS. 2 and 3—and disengages ratchet 20.

Ratchet 20 can therefore elastically rotate in the second direction about axis A and under the action of spring 19 up to reach the opening position (not-shown) in which seat 17 is aligned with direction C. In case of collision of motor vehicle 3, especially of lateral impact against door 2, supporting body 11 is subjected to an acceleration directed along direction C both in a first sense (downwards in FIG. 4) and in a second sense (upwards in FIG. 4). Due to this acceleration, inertial lever 50 rotates about axis E in the second direction—clockwise in FIG. 4—from the stable first position to the second position, thus tending spring 90.

The elastic action of spring 90 rotates blocking lever 80 about axis F in the second direction—clockwise with reference to FIGS. 2 to 6—from the release position to the stable blocking position. When inertial lever 50 reaches the second position and blocking lever 80 reaches the stable blocking position, apex 63 of inertial lever 50 engages vane 83 of blocking lever 80, as shown in FIG. 4. In this way, inertial lever 50 is prevented from returning in the release position and from rebounding between the release position and the stable blocking position.

Furthermore, when inertial lever 50 reaches the second position, pin 62 abuts against tooth 65 of lever 40, thus preventing the accidental rotation of lever 40 from the latched position to the unlatched position in the first direction—anticlockwise in FIGS. 2 to 6—under the acceleration resulting from the collision of motor vehicle 3. Accordingly, blocking lever 80 keeps inertia lever 50 in the second position, thus avoiding that the acceleration due to the collision causes the accidental release of pawl 21 and ratchet 20.

After the collision of motor vehicle 3, it is possible to arrange ratchet 20 in the open configuration, by simply actuating inner handle 5. As a matter of fact, the actuation of inner handle 5 causes the rotation in the second direction—anticlockwise in FIGS. 2 to 6—of lever 41 about axis D. As a result of the rotation of lever 41, surface 58*b* of tooth 56 moves beyond pin 82 of blocking lever 80 and surface 59 of tooth 57 engages appendix 32 of pawl lever 26 (FIG. 5).

Accordingly, blocking lever 80 moves back from the stable blocking position towards the release position. In the meanwhile, pawl lever 26 and pawl 21 rotate in the second direction—clockwise in FIGS. 2 to 6. Thus, pawl 21 disengages from ratchet 20, which can reach the opening position.

The rotation about axis F of blocking lever 80 from the stable blocking position to the release position causes, thanks to the elastic action of spring 90, the rotation about axis E of inertia lever 50 from the second position to the first position in the first direction—anticlockwise in FIGS. 2 to 6. In other words, the activation of lever 41 connected to inner handle 5 causes the movement of blocking lever 80 from the stable blocking position to the release position.

Figure 7:
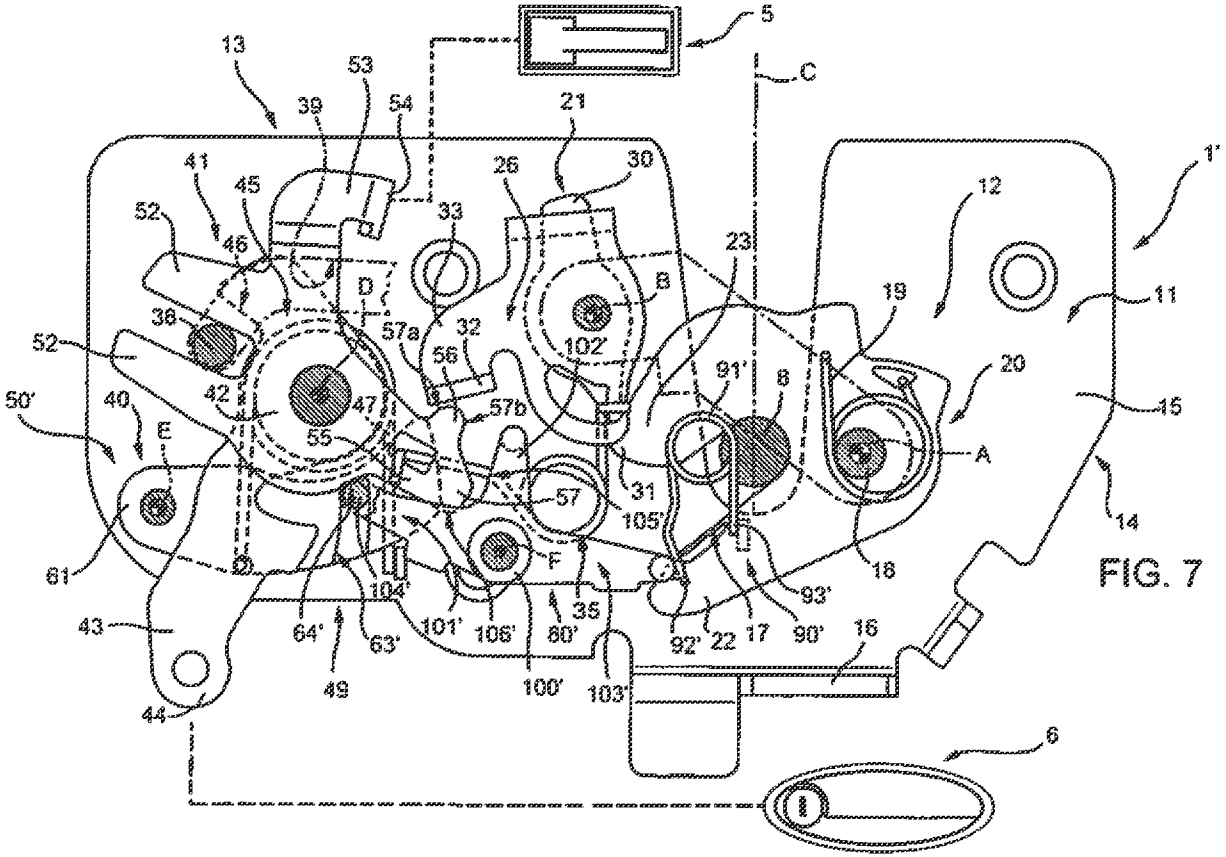
FIG. 7 is a top view of a latch constructed in accordance with the present disclosure illustrating an opening mechanism in an unlatched position, an inertia lever in a first position, and a blocking lever in a release position, with parts removed for clarity.
Figure 8:
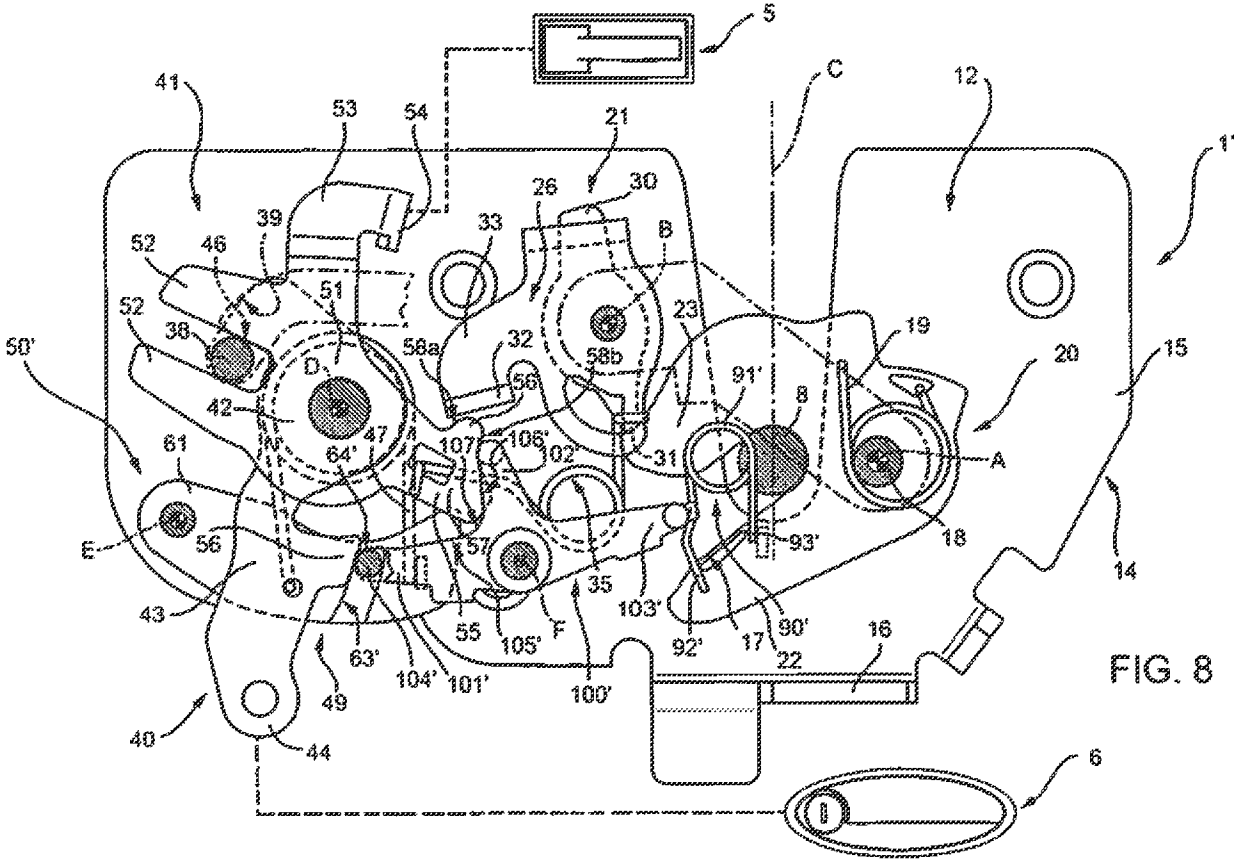
FIG. 8 is a top view of the latch of FIG. 7 illustrating the opening mechanism of the latch in an unlatched position, the inertia lever of in a second position, and the blocking lever in the stable blocking position, with parts removed for clarity.
Figure 9:
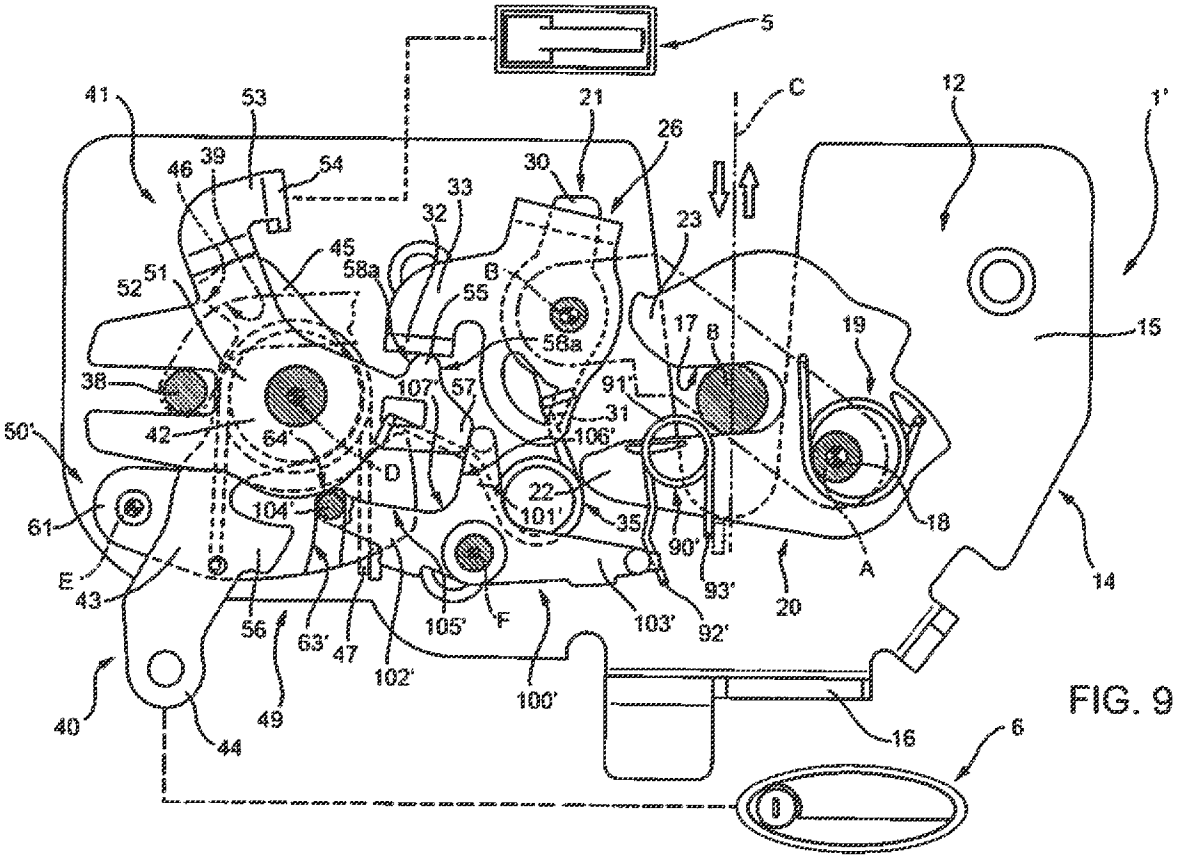
FIG. 9 is a top view of the latch of FIGS. 7 and 8 illustrating a reset operation during which the blocking lever returns back in the release position, with parts removed for clarity.

With reference to FIGS. 7 to 9, a second embodiment of the latch 1' is generally shown. The latch 1' is similar to latch 1 and will be described hereinafter only as far as it differs therefrom; corresponding or equivalent parts of latches 1, 1' will be indicated where possible by the same reference numbers.

Inertia lever 50' of latch 1' differs from inertia lever 50 of latch 1 in that it no longer comprises pin 62. Inertia lever 50' of latch 1' also differs from inertia lever 50 of latch 1 in that arm 61 comprises a groove 63'. Groove 63' is shaped as an arc having center on axis E. Groove 63' is delimited, on the side of axis D, by an abutting surface 64' defined by arm 61 and is, on the opposite side, open. Groove 63' is, in the embodiment shown, a relief defined inside arm 61 of inertia lever 50'.

Blocking lever 80' differs from blocking lever 80 by a pin 100' hinged to supporting body 11 about axis F; and three arms 101', 102', 103' which radially protrude from pin 100' with respect to axis F. Arm 101' precedes arm 102' and arm 102' precedes arm 103', proceeding about axis F in the second direction—clockwise—when blocking lever 80' is in the release position (FIG. 7). Arms 101', 102' and 102', 103' are angularly spaced for substantially 90 degrees and arms 103', 101' are angularly spaced for substantially 180 degrees. Arm 101' is directed towards inertia lever 50'.

Furthermore, arm 101' comprises an element 104' which engages groove 63'. Element 104' defines an end of arm 101' opposite with respect to axis F. When inertia lever 50' is in the first position and blocking lever 80' is in the release position, element 104' is disengaged from the trajectory of lever 40 from the respective latched position to the respective unlatched position (FIG. 7).

As best shown in FIG. 8, when inertia lever 50' rotates from the first position to the second position, surface 64' of groove 63' causes the rotation of element 104' and, therefore, of arm 101' and blocking lever 80' in the first direction—anticlockwise in FIGS. 7 to 9. When inertia lever 50' is in the second position and blocking lever 80' is in the stable blocking position, element 104' abuts against tooth 56 of lever 40 and is interposed along the trajectory of lever 40 from the respective latched position to the respective unlatched position (FIG. 8).

Arm 102' extends towards pawl lever 26 and pawl 21. Arm 101' and arm 102' comprise respective surfaces 105', 106' adjacent to each other and defining a vane 10T on the side of inertia lever 50'.

When inertia lever 50' is in the first position and blocking lever 80' is in the release position (FIG. 7), tooth 57 of lever 41 contacts surface 105' of arm 101' and tooth 56 is disengaged from surface 106' of arm 102'. When inertia lever 50' is in the second position and blocking lever 80' is in the blocking stable position (FIG. 8), tooth 56 of lever 41 abuts against surface 106' of arm 102'. Arm 103' extends on the opposite side of inertia lever 50' with respect to axis F.

Latch 1' also differs from latch 1 for comprising a spring 90' in place of spring 90. Spring 90' is interposed between supporting body 11 and arm 103' of blocking lever 80'. Furthermore, spring 90' pre-loads blocking lever 80' either towards the release position or towards the stable blocking position. In other words, spring 90' is bi-stable. Spring 90' comprises a cylindrical main portion 91' wound about an axis parallel to axes A, B, D, E, F and a pair of arms having respective ends 92', 93' fixed to arm 103' and to supporting body 11 respectively.

Latch 1' also differs from latch 1 in that, when blocking lever 80' is set in the stable blocking position, inertia lever 50' can rebound between the second position and the first position. Furthermore, the activation of inner handle 5 and the rotation of lever 41 in the first direction moves back inertia lever 50' in the first position.

The operation of latch 1' is similar to unit 1 and is described only insofar as it differs from that of latch 1. In particular, during a normal operation of motor vehicle 3 and when ratchet 20 is in the closing position, spring 90' keeps blocking lever 80' in the release position and inertia lever 50' is kept in the first position (FIG. 7). Furthermore, element 104' of arm 101' is in contact with surface 64' of groove 63'.

In this configuration, tooth 57' of lever 41 contacts surface 105' of arm 101' and tooth 56 is disengaged from surface 106' of arm 102'. In this way, the rotation of lever 41 from the latched position to the unlatched position does not interfere with blocking lever 80'. Accordingly, when outer handle 6 is actuated, levers 40, 41 rotate from the respective unlatched position to the respective latched positions.

In case of collision of motor vehicle 3, especially of lateral impact against door 2, supporting body 11 is subjected to an acceleration directed along direction C both in a first sense (downwards in FIGS. 7 to 9) and in a second sense (upwards in FIGS. 7 to 9), opposite to the first sense. Due to this acceleration, inertia lever 50' rotates about axis E in the second direction—clockwise in FIG. 8—from the stable first position to the second position. As a result, surface 64' thrusts element 104' downwards, thus causing the rotation of blocking lever 80' in the first direction—anticlockwise in FIGS. 7 to 9, up to the stable blocking position. Spring 90' firmly keeps blocking lever 80' in the stable blocking position.

At this stage, and as shown in FIG. 8, tooth 56 of lever 41 abuts against surface 106' of arm 102'. Furthermore, element 104' abuts against tooth 65 of lever 40. As a result, blocking lever 80' is interposed along the trajectory of lever 40 from the latched position to the unlatched position. In this way, blocking lever 80' prevents that opening mechanism 13 from accidentally moving from the latched position to the unlatched position, under the acceleration resulting from the collision of motor vehicle 3.

When blocking lever 80' is in the stable blocking position, inertial lever 50' can rebound between the first position and the second position under the variation of the orientation of the acceleration due to the collision. However, the rebounds of inertia lever 50' between the first position and the second position does not affect the position of blocking lever 80'. This is due to the fact that groove 63' can move with respect to element 104', when inertia lever 50' rotates back in the first direction—anticlockwise in FIGS. 7 to 9.

After the collision of motor vehicle 3, it is possible to displace ratchet 20 in the open configuration, by simply actuating inner handle 5. As a matter of fact, the actuation of inner lever handle 5 causes the rotation in the first direction—anticlockwise in FIG. 9—of lever 41 about axis D. As a result, tooth 57 causes the rotation of arm 102' and, therefore, of blocking lever 80' in the second direction—clockwise with reference to FIG. 9. Thus, surface 58*a* of tooth 56 engages appendix 32 of pawl lever 26 and causes the rotation of pawl lever 26 and pawl 21 about axis B in the second direction—clockwise in FIG. 9. Pawl 21 disengages from ratchet 20, which can reach the opening position. At the same time, blocking lever 80' reaches the release position under the elastic action of spring 90'. The rotation of blocking lever 80' in the second direction—clockwise in FIG. 9—about axis F from the stable blocking position to the release position causes the rotation of inertia lever 50' in the first direction—anticlockwise in FIG. 9—about axis E towards the first position, due to the action of elements 104' against abutting surface 64'.

With reference to FIGS. 10 to 15, a third embodiment of the latch 1" is generally shown. The latch 1" is similar to latch 1 and will be described hereinafter only as far as it differs therefrom; corresponding or equivalent parts of latches 1, 1" will be indicated where possible by the same reference numbers.

Latch 1" differs from latch 1 in that blocking lever 80" moves from the release position (shown in FIG. 10) to the stable blocking position (shown in FIG. 11) through a translation along an axis G" from the release position to an intermediate position and a subsequent rotation about the axis G" in the first direction (anticlockwise in FIGS. 14 and 15) from the intermediate position to the stable blocking position, and vice-versa. In particular, the rotation about axis E of inertia lever 50" in the second direction—clockwise in FIGS. 10 to 13—causes the translation of blocking lever 80" parallel to axis G" from the release position to the intermediate position. The subsequent rotation about axis G" of blocking lever 80" in the first direction is caused by a spring 90", as it will be described in more detail in the following description.

Latch 1" also differs from latch 1 in that blocking lever 80" abuts against a housing 130" defined by supporting body 11, when blocking lever 80" is in the stable blocking position. Axis G" is orthogonal to axes A, B, D, E and parallel to and staggered from direction C.

Additionally, latch 1" differs from latch 1 in that lever 41 comprises a further tooth 59" which is angularly interposed about axis D between teeth 52 and arm 55.

In greater detail, blocking lever 80" differs from blocking lever 80 by a hub 120" which can slide relative to supporting body 11 along an axis G" and can rotate about axis G" with respect to supporting body 11, an arm 121" and an arm 122", which project from hub 120" and on a first side of hub 120", and an arm 123", which projects from hub 120" on a second side, opposite to first side, of hub 120".

Inertia lever 50" and levers 40, 41 are arranged on the first side of axis G". Ratchet 20 is arranged on the second side of axis G".

Arms 121", 122", 123" are integral with hub 120". As best shown in FIG. 16, arm 121" comprises, on the side of lever 41 and inertia lever 50", a surface 126" and appendix 127". Surface 126" is radially inner with respect to appendix 127" and with reference to axis G". Appendix 127" is closer to lever 41 and inertia lever 50" than surface 126". Surface 126" is angularly spaced from pin 62" of inertia lever 50, when the latter is set in the first position.

Figure 10:
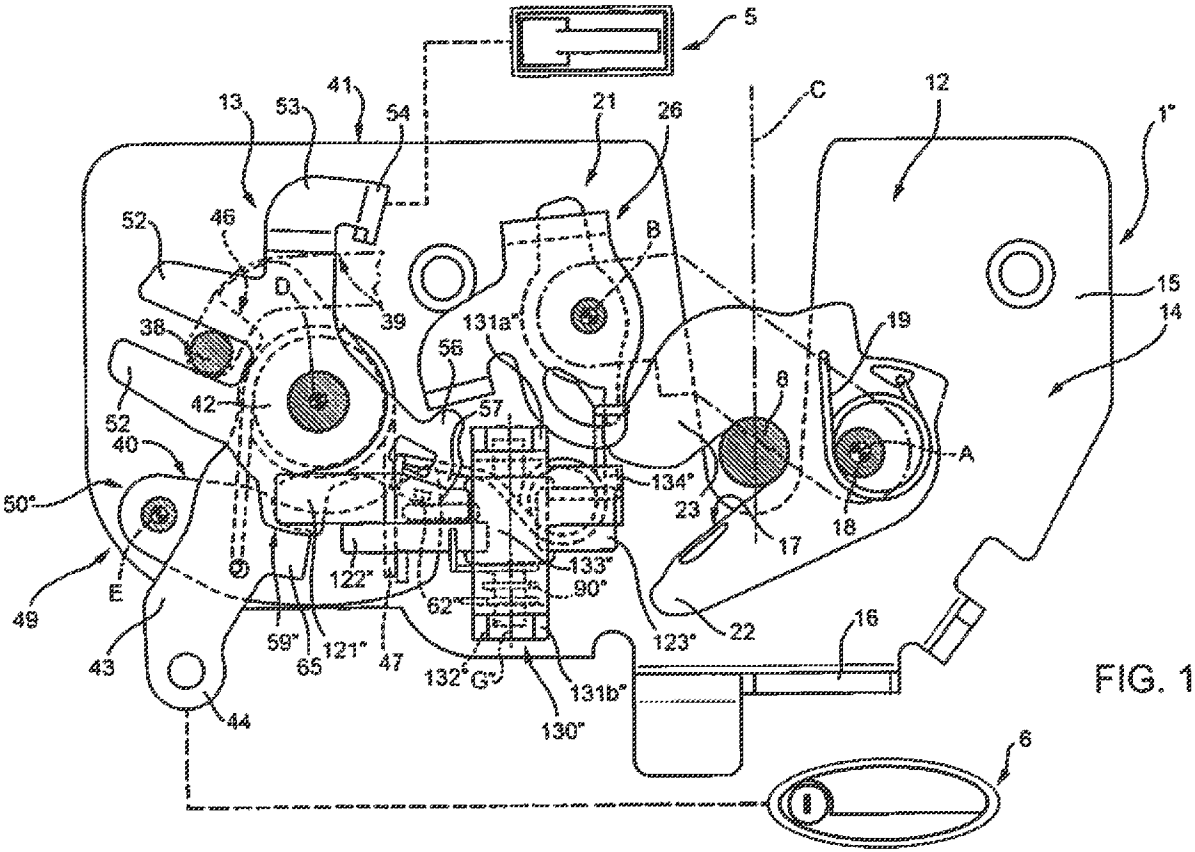
FIG. 10 is a latch constructed in accordance with the present disclosure illustrating an opening mechanism in an unlatched position, an inertia lever of in a first position, and a blocking lever in a release position with parts removed for clarity.
Figure 11:
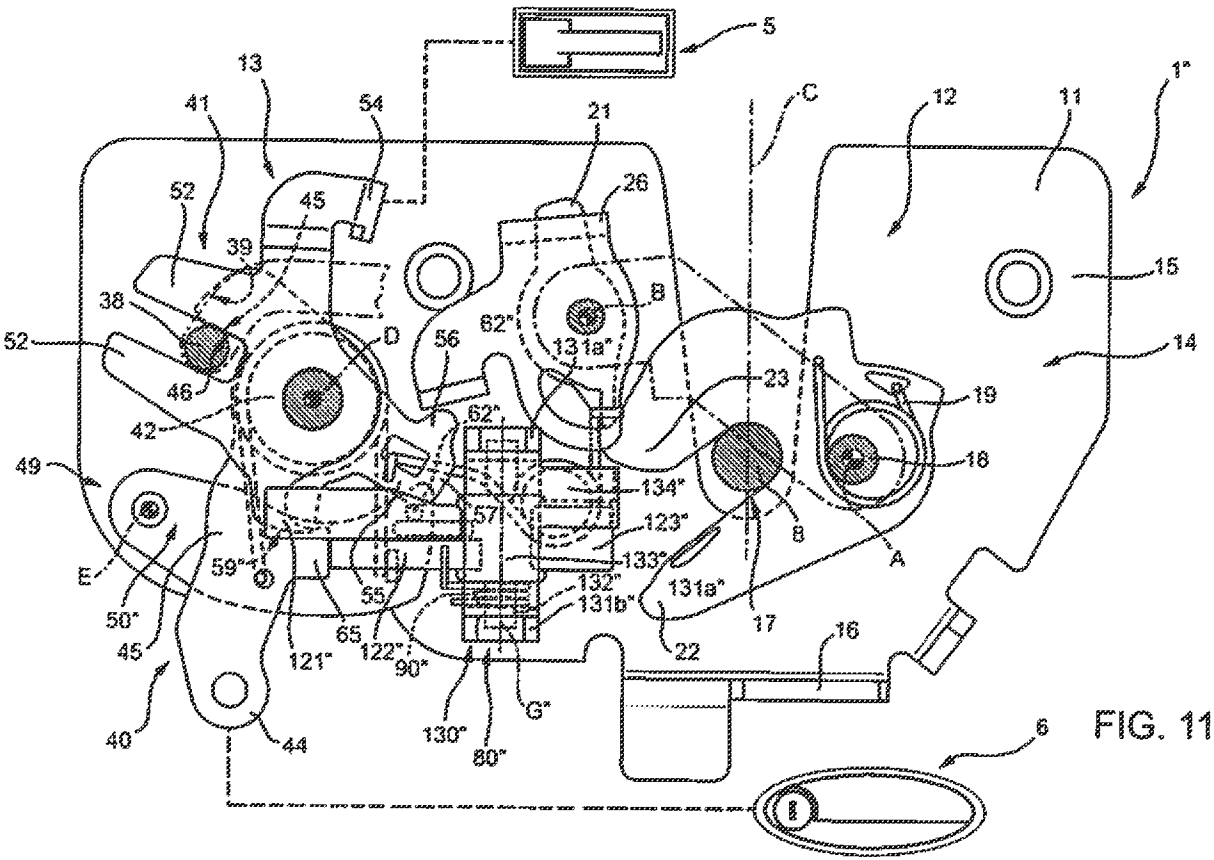
FIG. 11 is a top view of the latch of FIG. 10 illustrating the opening mechanism of the latch in an unlatched position, the inertia lever of in a second position, and the blocking lever in the stable blocking position, with parts removed for clarity.
Figure 15:
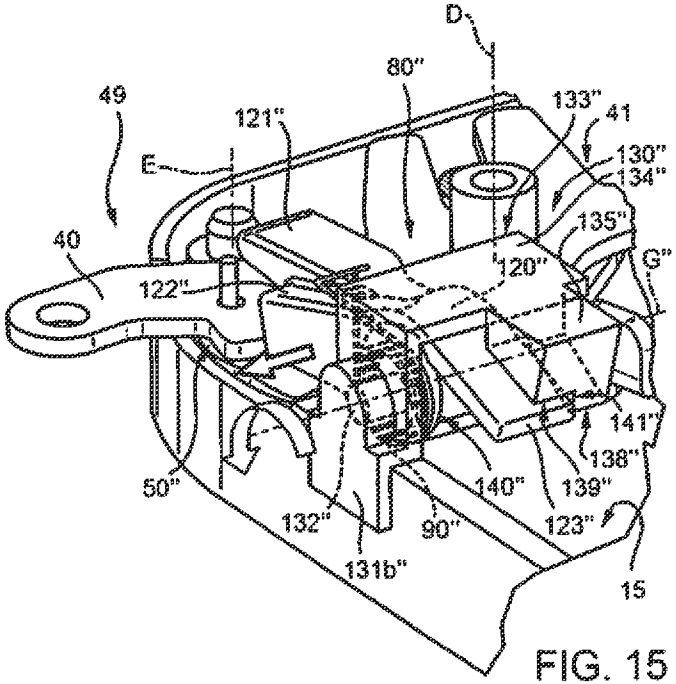
FIG. 15 is a larger scale perspective view of the latch of FIGS. 10 to 13 taken from the first perspective angle, with parts removed for clarity.

Arm 121" is contacted and thrust by pin 62" of inertia lever 50 parallel to axis G", when the latter reaches the second position, under the acceleration resulting parallel to direction C from the collision of door 2 of motor vehicle 3. Arm 122" is rotatable about axis G" together with hub 120" between a raised position, in which it is arranged above lever 40 and, therefore, is disengaged from lever 40 (FIGS. 10 and 14) and a lowered position, in which it contacts tooth 65 of lever 40 and is interposed along the trajectory of lever 40 from the unlatched position to the latched position (FIGS. 11 and 15). In particular, arm 122" is arranged in the raised position, when hub 120" moves parallel to axis G" between the release position and the intermediate position.

Figure 12:
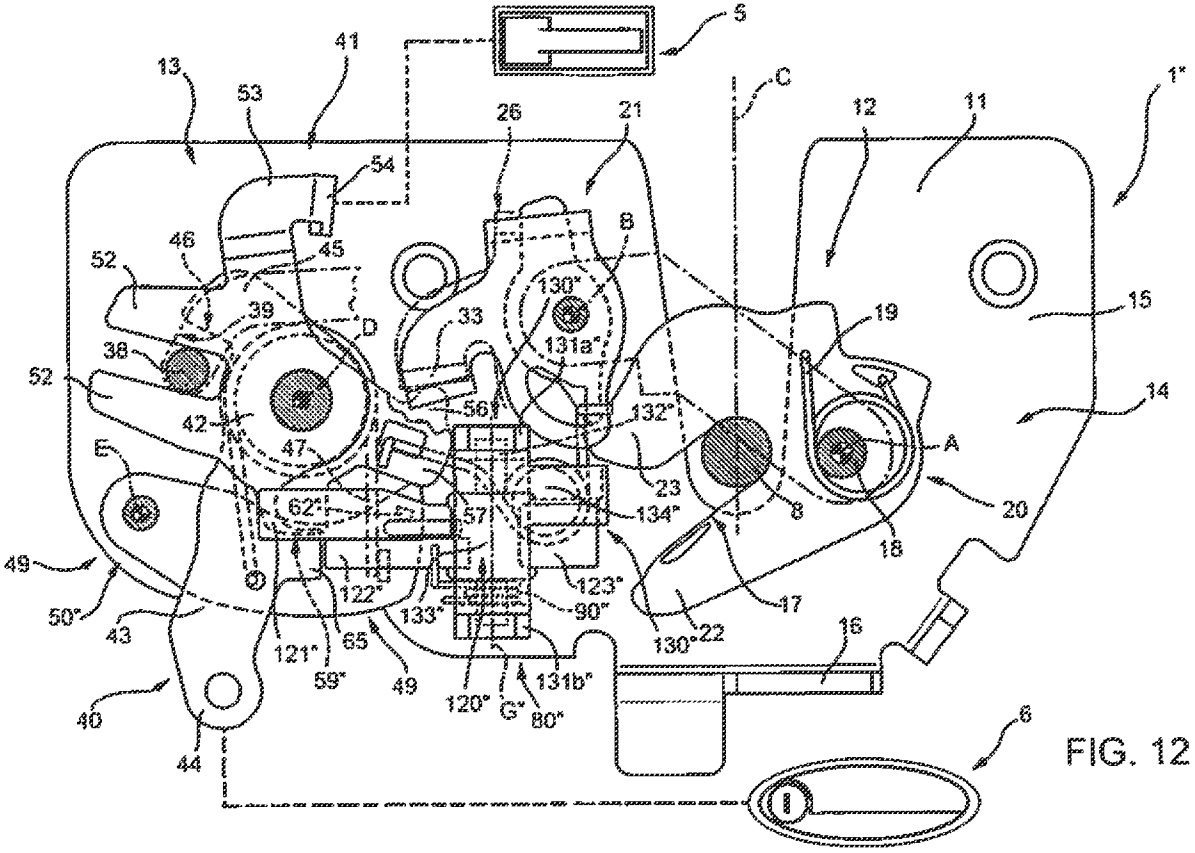
FIG. 12 is a top view of the latch of FIGS. 10 and 11, showing a reset operation during which the blocking lever returns back in the release position.
Figure 14:
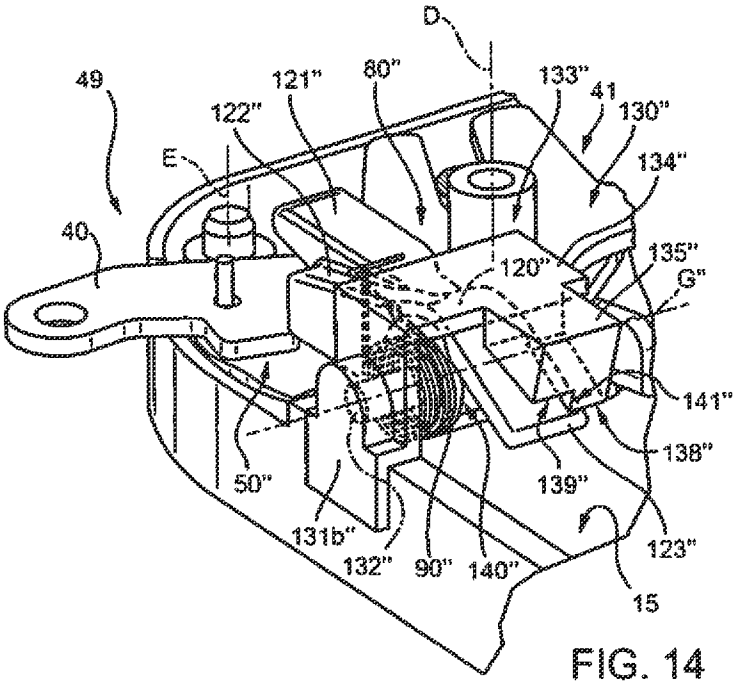
FIG. 14 is a larger scale perspective view of the latch of FIGS. 10 to 13 taken from a first perspective angle, with parts removed for clarity.

Furthermore, arm 122' is in arranged in the lowered position, when hub 120" reaches the stable blocking position, after having rotated about axis G" as of the intermediate position in the first direction—anticlockwise in FIGS. 14 and 15. When arm 121" is in the lowered position (FIGS. 11 and 15) and inner handle 5 is not flexed, tooth 59" of lever 41 is disengaged from arm 121". Staring from that position, the actuation of inner lever 5 causes the rotation in the first direction—anticlockwise in FIGS. 11 and 12—of lever 41. As a result, tooth 59" engages arm 121" and raises the latter from the respective lowered position in the respective raised position (FIG. 12).

Arm 123" is rotatable about axis G" together with hub 120" between a lowered position, in which it is arranged below housing 130" and a raised position, in which it is elastically loaded by spring 90" against housing 130". In particular, arm 123" is set in the lowered position, when hub 120" moves parallel to axis G" between the release position and the intermediate position. Furthermore, arm 123" is set in the raised position, when blocking lever 80" has reached the stable blocking position, after having rotated about axis G" as of the intermediate position in the first direction—anticlockwise in FIGS. 14 and 15.

As best shown in FIGS. 14 and 15, housing 130" houses blocking lever 80" and comprises a pair of plates 131*a*", 131*b*" spaced along axis G" and a guide 132", which extends between plates 131*a*", 131*b*" parallel to axis G" and supports hub 120" slidably along and angularly about axis G". In particular, plate 131*a*" is arranged on the side of pawl lever 26 and pawl 21. Plate 131*b* is arranged along axis G" on the opposite side of plate 131*a*". Starting from plate 131*a* and proceeding towards plate 131*b* parallel to axis G", arm 121' precedes arm 122'.

As best shown in FIGS. 14 and 15, housing 130" also includes a plate 133" which extends between plates 131*a*", 131*b*" and is spaced from plate 15 parallel to axes A, B, D, E. As best shown in FIG. 14, plate 133" comprises a main portion 134", which extends along axis G" between plates 131*a*", 131*b*" and Is superimposed to hub 120", and an appendix 135", which projects from portion 134' on the second side of hub 120" and is superimposed to arm 123". In particular, appendix 135" is bounded, on the side of arm 123" and of plate 15, by a surface 138" inclined with respect to axis G", a surface 139" inclined with respect to axis G", and a shoulder 141" interposed between surfaces 138", 139".

Surface 139" is arranged, along axis G", on the side of plate 131*b*" and is interposed between surface 138*a*" and plate 131*b*". Surfaces 138", 139" are inclined with respect to the plane of plate 15 of supporting body 11. Surface 139" is closer than surface 138" to plate 5 and to hub 120".

Latch 1" also differs from latch 1 in that spring 90" extends along direction G" and is interposed between housing 130" and hub 120". In particular, and as best shown in FIGS. 14 and 15, spring 90" is interposed between an axial end wall 140" of hub 120" and plate 131*b*". Furthermore, spring 90" is both an axial spring and a torsional spring. In particular, spring 90" exerts on hub 120" a translational elastic pre-loading directed along axis G" and towards the release position of blocking lever 80", i.e. towards plate 131*b*".

Furthermore, spring 90" exerts on hub 120" an elastic pre-loading torque directed about axis G" and towards the stable blocking position of blocking lever 80", i.e. towards surface 139" of housing 130" and in the first direction—anticlockwise with reference to FIGS. 14 and 15. In this way, when hub 120" advances along axis G" and compresses spring 90", the latter both exerts an action along axis G" on hub 120" towards plate 131*b*", and causes the rotation about axis G" in the first direction (anticlockwise in FIGS. 14 and 15) up to a position in which arm 123" abuts against surface 139". On the contrary, when hub 120" rotates in the second direction (clockwise in FIGS. 14 and 15) from the stable blocking position to the intermediate position, spring 90" extends and thrusts blocking lever 80" towards the release position.

Additionally, latch 1" also differs from latch 1 in that, when blocking lever 80" is set in the stable blocking position, inertia lever 50" can rebound between the second position and the first position. Furthermore, the activation of inner handle 5 and the rotation of lever 41 in the first direction moves back inertia lever 50' in the first position.

The operation of latch 1" is similar to unit 1 and is described only insofar as it differs from that of latch 1. In particular, during a normal operation of motor vehicle 3 and when ratchet 20 is in the closing position, spring 90" is extended and keeps blocking lever 80" in the release position while inertia lever 50" is kept in the first position, as shown in FIG. 10.

In this configuration, pin 62" of inertia lever 50" is disengaged from surface 126" of arm 121" of blocking lever 80". Arm 122" is in the raised position, in which it is disengaged and spaced from lever 40 and does not interfere with the movement of lever 40 from the respective unlatched position to the unlatched position. Arm 123" is in the lowered position in which it is spaced from surface 139" of housing 130" (FIG. 4).

Accordingly, when outer handle 6 is actuated, levers 40, 41 rotate from the respective unlatched positions to the respective latched positions. When latch 1" is subjected to an acceleration directed along direction C both in a first sense (downwards in FIGS. 10 to 13) and in second sense (upwards in FIGS. 10 to 13), inertia lever 50" rotates about axis E in the second direction—clockwise in FIGS. 10 to 13—from the stable first position (FIG. 10) to the second position (FIG. 11). As a result, and as best shown in FIG. 16, pin 62" of inertia lever 50" thrusts surface 126" of arm 121" parallel to axis G" towards plate 131*b*".

In this way, blocking lever 80" slides parallel to axis G" from the release position to the Intermediate position. At the same time, spring 90" is compressed and applies an elastic torque on the blocking lever 80" directed about axis G" and in the first direction—anticlockwise in FIGS. 14 and 15. As a result, when it is in the intermediate position and arm 123" is no longer in contact with surface 138", blocking lever 80" rotates in the first direction up to reach the stable blocking position.

Figure 13:
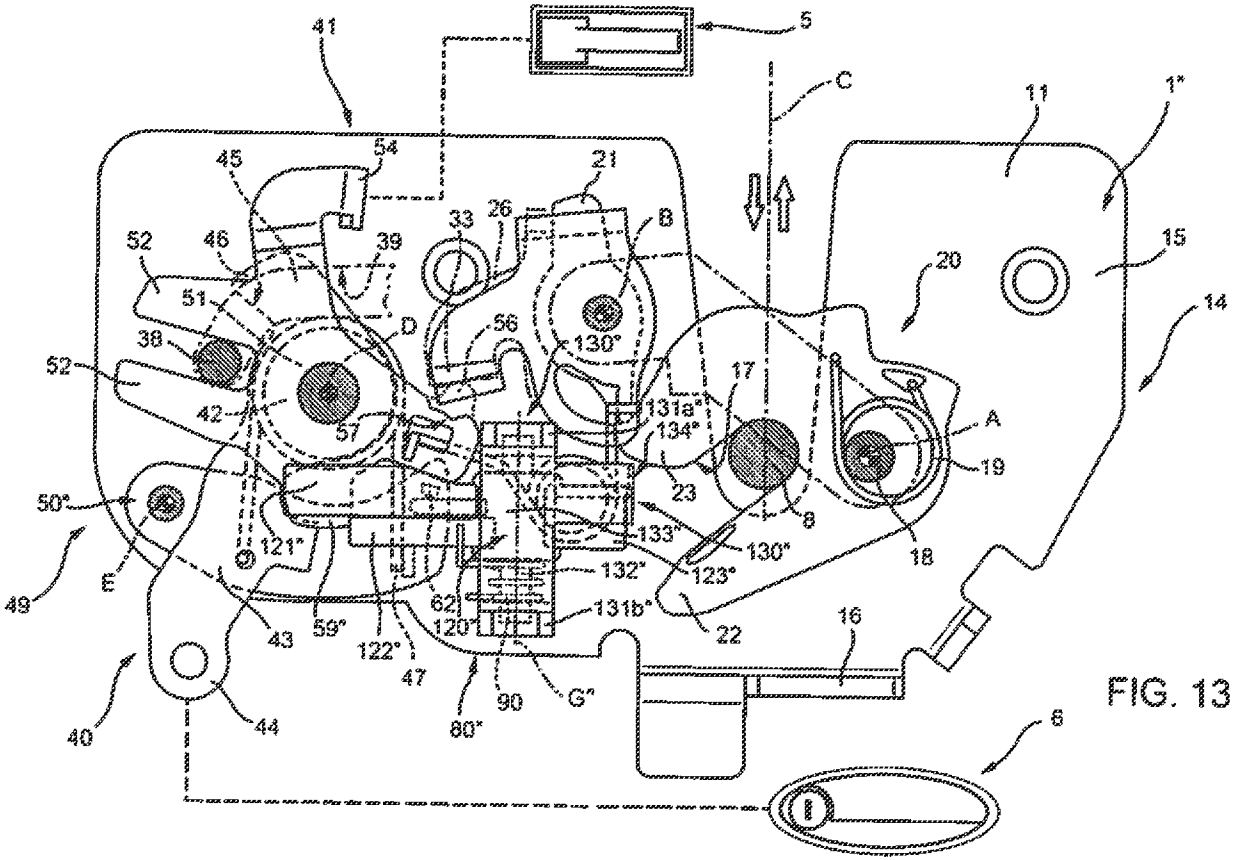
FIG. 13 is a top view of the latch of FIGS. 10 and 11, showing a reset operation during which the blocking lever returns back in the release position.

In this situation, arm 123" is in the raised position and is stably arrested by surface 139" of housing 130". Arm 122" is in the lowered position, in which it engages with tooth 65 and is interposed along the trajectory of lever 40 from the respective latched position to the respective unlatched position, as shown in FIG. 13. Arm 122" is also spaced from tooth 59" of lever 41. In this way, blocking lever 80" prevents opening mechanism 13" from accidentally moving from the latched position to the unlatched position, under the acceleration resulting from the collision of motor vehicle 3.

The stable blocking position is made stable by the fact that surface 139" contrasts the elastic action of spring 90" and firmly keeps blocking lever 80" in the stable blocking position. After the collision of motor vehicle 3, it is possible to displace ratchet 20 in the open configuration, by actuating inner handle 5. The actuation of inner handle 5 causes the rotation in the first direction—anticlockwise in FIGS. 12 and 13—. In this way, tooth 59" of lever 41 rotates, against the action of spring 90" (FIG. 16), arm 122" of blocking lever 80" from the respective lowered position to the respective raised position, in which arm 122" is disengaged from lever 40. Thus, surface 58*a* of tooth 56 engages appendix 32 of pawl lever 26 and causes the rotation of pawl lever 26 and pawl 21 about axis B (see the dashed line in FIGS. 12 and 13) in the second direction—clockwise in FIGS. 12 and 13. Pawl 21 disengages from ratchet 20, which can, therefore, reach the opening position.

The rotation of tooth 59" of lever 41 causes whole blocking lever 80" rotating about axis B in the second direction—clockwise in FIGS. 14 and 15—from the stable blocking position to the intermediate position. Accordingly, arm 121" rotates about axis B from the respective lowered position to the respective raised position, and arm 123" rotates about axis B from the respective raised position to the respective lowered position in which it is disengaged from surface 139" of housing 130".

At this stage, spring 90" extends parallel to axis G" and thrusts whole blocking lever 80" in the respective release position (FIG. 10). When blocking lever 80" is in the stable blocking position, inertia lever 50" is free to rebound between the first position and the second position. The displacement of blocking lever 80" under the action of lever 41 from the stable blocking position to the release position causes the rotation of inertia lever 50"—about axis E towards the first position.

Advantageously, blocking lever 80, 80', 80" is movable between the release position and the stable blocking position, when inertia lever 50, 50', 50" oscillates from the first position to the second position. In this way, blocking lever 80, 80', 80" is effective in preventing in a stable way lever 40 and, therefore, whole opening mechanism 13, from accidentally moving from the latched position to the unlatched position, under the action of the acceleration directed along direction C and deriving from the collision of motor vehicle 3. As a result, blocking mechanism 49 is capable of securing in a stable way lever 40—and, therefore, whole opening mechanism 13—in the respective latched position, both when the acceleration is directed in a first sense and in a second sense.

Furthermore, the securing of lever 40—and, therefore, of whole opening mechanism 13—in the respective latched position no longer relies on the synchronization between inertia lever 50 and lever 40, as in the known solution discussed in the introductory part of the present description. Accordingly, the operation of blocking mechanism 49 is particularly repeatable when compared with the known solution discussed in the introductory part of the present description.

Spring 90, 90', 90" is effective in keeping in a stable way blocking lever 80, 80', 80" in the stable blocking position. Furthermore, blocking lever 80, 80', 80" can be moved back from the stable blocking position to the release position, by simply flexing inner handle 5 so as to cause the rotation of lever 41. Blocking lever 80, 80' is hinged about axis F, F' and is movable in a plane transversal to axis F, F' between said release position and said stable blocking position. In this way, blocking lever 80, 80' is easy to move and to control.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. For example, changes may be made to latch 1, 1', 1" as described and illustrated herein without, however, departing from the scope defined in the accompanying claims. Such variations are not to be regarded as a departure from the disclosure, and all such modifications are intended to be included within the scope of the disclosure.

The invention claimed is:

1. A latch for a door of a motor vehicle, said latch comprising:

a supporting body;

a closing assembly including a ratchet moveably connected to said supporting body and adapted to cooperate with a latch striker, wherein said ratchet is moveable to a closing configuration in which said ratchet engages said latch striker and keeps said ratchet in a fixed position, and an open configuration in which said ratchet is disengaged from said latch striker;

said closing assembly further including a pawl moveably connected to said supporting body and moveable between a first position in which said pawl blocks said ratchet in said closing configuration, and a second position in which said pawl allows said ratchet to rotate between said open and closing configurations, and wherein said closing assembly further includes a pawl lever moveable with said pawl;

an opening mechanism selectively moveable between a latched configuration in which said opening mechanism is disengaged from said pawl lever to leave said ratchet in said closing configuration, and an unlatched configuration, in which said opening mechanism engages said pawl lever to cause said ratchet to move from said closing configuration to said opening configuration;

an inertia lever, which is moveably connected to said supporting body and moveable relative to said supporting body between a first position and a second position;

a blocking lever movable between a release position in which said blocking lever allows said opening mechanism to move from said latched configuration to said unlatched configuration and a stable blocking position, in which said blocking lever prevents said opening mechanism from moving from said latched configuration to said unlatched configuration; and said inertia lever and said blocking lever being coupled in such a way that the movement of said inertia lever from said first position to said second position causes the movement of said blocking lever from said release position to said stable blocking position.

2. The latch of claim 1 further comprising elastic means connected to said blocking lever and which elastically loads said blocking lever towards said stable blocking position.

3. The latch of claim 1, wherein said opening mechanism comprises:

a first lever operatively connected to an outer handle of said door, and which moves from a first latched position in which said first lever leaves said closing mechanism in said closed configuration and a first unlatched position in which said first lever causes said closing mechanism to move in said open configuration;

a second lever operatively connected to an inner handle of said door, and which moves from a second latched position in which said second lever leaves said closing mechanism in said closed configuration and a second unlatched position in which said second lever causes said closing mechanism to move in said open configuration; and said blocking lever preventing, when set in said stable blocking position, the displacement of said first lever from said first latched position to said unlatched position;

wherein the displacement of said second lever from said second latched position to said second unlatched position causes the movement of said blocking lever back from said stable blocking position to said release position.

4. The latch of claim 3, wherein said elastic means are interposed between said blocking lever and said inertia lever;

said elastic means being configured to convert the oscillation of said inertia lever from said first position to said second position in the movement of said blocking lever from said release position to said stable blocking position.

5. The latch of claim 4, wherein said blocking lever comprises:

a first main body hinged about said first axis;

a first pin protruding from said body; and said first pin being adapted to be displaced by said second lever travelling from said latched position to said unlatched position, so as to move said blocking lever from said stable blocking position to said release position.

6. The latch of claim 4, wherein said first main body defines a first abutting surface which is engaged with a second abutting surface of said inertia lever, when said blocking lever is in said stable blocking position and said inertia lever is in said second position, so as to block said inertia lever in said second position;

said first abutting surface being disengaged from said second abutting surface, when said blocking lever is in said release position and said inertia lever is in said first position, so as to allow said inertia lever to return in said first position.

7. The latch of claim 6, wherein the movement of said second lever from said respective latched position to said unlatched position causes the disengagement of said first abutting surface and said second abutting surface.

8. The latch of claim 3 wherein said inertia lever comprises:

a main body;

a first pin protruding from said main body;

said first abutting surface, which is defined by said main body; and said first pin being disengaged from the trajectory of said first lever from said latched position to said unlatched position when said blocking lever is in said release position, and being interposed along said trajectory when said blocking lever is in said blocking position.

9. The latch of claim 1, wherein said blocking lever is hinged about an axis and is movable in a plane transversal to said axis between said release position and said stable blocking position.

10. The latch of claim 1, wherein said inertia lever is configured, when arranged in said second position, to contact said opening mechanism and to prevent said opening mechanism from moving from said unlatched configuration to said latched configuration; and said blocking lever being configured, when arranged in said stable blocking position, to keep said inertia lever in said second position, so as to indirectly prevent said opening mechanism from moving from said unlatched configuration to said latched configuration.

11. The latch of claim 1, wherein said inertia lever and said blocking lever are coupled in such a way that when said blocking lever reaches said stable blocking position, said inertia lever is blocked in said second position.

12. The latch of claim 1, wherein said inertia lever and said blocking lever are coupled in such a way that the movement of said inertia lever from said second position to said first position leaves said blocking lever in said stable blocking position.

13. The latch of claim 1, wherein said elastic means are interposed between said supporting body and said blocking lever.

14. The latch of claim 1, wherein said elastic means comprise a bi-stable spring;

said bi-stable spring loading said blocking lever toward said release position or said blocking position.

15. The latch of claim 1, wherein said inertia lever defines an open groove and said blocking lever comprises an element arranged inside said groove;

said element being interposed along a trajectory of said first lever from respective latched position to respective un-latched position, when said blocking lever is in said stable blocking position;

said element being detached from said trajectory of said first lever from respective latched position to respective un-latched position, when said blocking lever is in said release position;

said groove and said element moving together, when said inertia lever moves from said first position to said second position, so as to cause said blocking lever to move from said release position to said stable blocking position; and said groove and said element being movable relative to one another, when said inertia lever returns from said second position to said first position, so as to leave said blocking lever in said stable blocking position.

16. The latch of claim 15, wherein said blocking lever is hinged to said supporting body about a first axis and comprises:

a first arm, which carries said element; and a second arm, to which said elastic means are connected.

17. The latch of claim 1, wherein said blocking lever is slidable along said second axis with respect to said supporting body from said release position to an intermediate position and is rotatable about said second axis from said intermediate position to said stable blocking position, when said inertia lever moves from said first position to said second position.

18. The latch of claim 17, wherein said elastic means are interposed between said supporting body and said blocking lever;

said elastic means being configured to exert on said blocking lever both an action along said second axis and a torque about said second axis;

said action directed parallel to said second axis pre-loading said blocking lever towards said release position; and said torque directed about said second axis pre-loading said blocking lever toward said stable blocking position.

19. The latch of claim 17, wherein said supporting body comprises a housing which at least partly houses said blocking lever and defines an abutting surface which stably blocks said blocking lever in said stable blocking position.

20. The latch of claim 19, wherein said blocking lever comprises:

a hub, which is slidable along and rotatable about said second axis with respect to said supporting body;

a first arm, which is operatively connected to said hub and is adapted to be contacted by said inertia lever, when said inertia lever moves from said first position to said second position;

a second arm, which is operatively connected to said hub and rotatable, when said blocking lever is in said intermediate position, about said second axis between a first disengaged angular position, in which said second arm is disengaged from the trajectory of said first lever from said latched position to said unlatched position and a first engaged angular position in which said second arm is interposed along said trajectory of said first lever; and a third arm, which is operatively connected to said hub and rotatable, when said blocking lever is in said intermediate position, between a second disengaged position in which said third arm is detached from said abutting surface and a second engaged position in which said third arm is pressed by said spring against said abutting surface.

21. The latch according to claim 20, wherein said second lever of said opening mechanism comprises a tooth which is disengaged from said second arm when said blocking lever is in said stable blocking position and said second lever is in said latched position and engaged with said second arm and moves said arm back from said respective first engaged position to said respective disengaged position and said blocking lever back from said stable blocking position to said intermediate position, when said second lever is in said latched position.

22. A motor vehicle comprising:

a door with an outer handle and an inner handle; and a latch according to claim 1.

23. A latch for a door of a motor vehicle, said latch comprising:

a supporting body;

a closing assembly including a ratchet rotatably connected to said supporting body and adapted to cooperate with a latch striker, wherein said ratchet is rotatable between a closing configuration in which said ratchet engages said latch striker and keeps said ratchet in a fixed position, and an open configuration in which said ratchet is disengaged from said latch striker;

said closing assembly further including a pawl rotatably connected to said supporting body and rotatable between a first position in which said pawl blocks said ratchet in said closing configuration, and a second position in which said pawl allows said ratchet to rotate between said open and closing configurations, and wherein said closing assembly further includes a pawl lever rotatable with said pawl;

an opening mechanism moveable between a latched configuration in which said opening mechanism is disengaged from said pawl lever to leave said ratchet in said closing configuration, and an unlatched configuration, in which said opening mechanism engages said pawl lever to cause said ratchet to move from said closing configuration to said opening configuration; and an inertia activated blocking mechanism, which is moveable, under the inertia action, from a release configuration, in which said inertia activated blocking mechanism allows said opening mechanism to move from said latched configuration to said unlatched configuration, to a stable blocking configuration, in which said inertia activated blocking mechanism prevents said opening mechanism from moving from said latched configuration to unlatched configuration;

said opening mechanism comprising:

a first lever operatively connected to an outer handle of said door, and which moves between a first latched position in which said first lever leaves said closing mechanism in said closed configuration, and a first unlatched position in which said first lever causes said closing mechanism to move to said open configuration; and a second lever operatively connected to an inner handle of said door, and which moves between a second latched position in which said second lever leaves said closing mechanism in said closed configuration, and a second unlatched position in which said second lever causes said closing mechanism to move to said open configuration;

wherein the displacement of said second lever from said second latched position to said second unlatched position causes the movement of said inertia activated blocking mechanism back from said stable blocking configuration to said release configuration.

24. A latch for a door of a motor vehicle, said latch comprising:

a supporting body;

a closing assembly including a ratchet rotatably connected to said supporting body and adapted to cooperate with a latch striker, wherein said ratchet is moveable between a closing configuration in which it engages said latch striker and keeps said ratchet in a fixed position, and an open configuration in which said ratchet is disengaged from said latch striker;

said closing assembly further including a pawl rotatably connected to said supporting body and rotatable between a first position in which said pawl blocks said ratchet in said closing configuration, and a second position in which said pawl allows said ratchet to rotate between said open and closing configurations, and wherein said closing assembly further includes a pawl lever rotatable with said pawl;

an opening mechanism moveable between a latched configuration in which said opening mechanism is disengaged from said pawl lever to leave said ratchet in said closing configuration, and an unlatched configuration, in which said opening mechanism engages said pawl lever to cause said ratchet to move from said closing configuration to said opening configuration; and an inertia activated blocking mechanism moveable relative to said supporting body under the inertia action, from a release configuration, in which said inertia activated blocking mechanism allows said opening mechanism to move from said latched configuration to said unlatched configuration, to a stable blocking configuration, in which said inertia activated blocking mechanism prevents said opening mechanism from moving from said latched configuration to unlatched configuration;

said opening mechanism comprising:

a first lever rotatably connected to the supporting body and operatively connected to an outer handle of said door, and rotatable between a first latched position in which said first lever leaves said closing mechanism in said closed configuration, and a first unlatched position in which said first lever causes said closing mechanism to move in said open configuration; and a second lever rotatably connected to said supporting body and operatively connected to an inner handle of said door, and which is moveable between a second latched position in which said second lever leaves said closing mechanism in said closed configuration, and a second unlatched position in which said second lever causes said closing mechanism to move in said open configuration;

wherein said blocking lever, when set in said stable blocking position, prevents said first lever from moving from said first latched position to said first unlatched position.

25. A latch for a door of a motor vehicle, said latch comprising:

a supporting body;

a closing assembly including a ratchet rotatably connected to said supporting body and adapted to cooperate with a latch striker, wherein said ratchet is rotatable between closing configuration in which it engages said latch striker and keeps said ratchet in a fixed position, and an open configuration in which said ratchet is disengaged from said latch striker;

said closing assembly further including a pawl rotatably connected to said supporting body and rotatable between a first position in which said pawl blocks said ratchet in said closing configuration, and a second position in which said pawl allows said ratchet to rotate between said open and closing configurations, and wherein said closing assembly further includes a pawl lever rotatable with said pawl;

an opening mechanism moveable between a latched configuration in which said opening mechanism is disengaged from said pawl lever to leave said ratchet in said closing configuration, and an unlatched configuration, in which said opening mechanism engages said pawl lever to cause said ratchet to move from said closing configuration to said opening configuration;

an inertia lever, rotatably connected to said supporting body and rotatable relative to said supporting body between a first position to a second position;

a blocking lever, which is movable between a release position in which said blocking lever allows said opening mechanism to move from said latched configuration to said unlatched configuration and a stable blocking position, in which said blocking lever prevents said opening mechanism from moving from said latched configuration to said unlatched configuration;

said inertia lever and said blocking lever being coupled in such a way that the movement of said inertia lever from said first position to said second position causes the movement of said blocking lever from said release position to said stable blocking position; and said blocking lever being hinged about an axis and being movable in a plane transversal to said axis between said release position and said stable blocking position.

* * * * *